US006250388B1

(12) United States Patent
Carmi et al.

(10) Patent No.: US 6,250,388 B1
(45) Date of Patent: Jun. 26, 2001

(54) GAS IMPULSE DEVICE AND METHOD OF USE THEREOF

(75) Inventors: Gennady Carmi, Beer Sheva (IL); Leonid Slez, Makeevkea (UA); Yuri Ass, Beer Sheva (IL)

(73) Assignee: Prowell Technologies Ltd, Sele Boker (IL)

( * ) Notice: Subject to any disclaimer, the term of this patent is extended or adjusted under 35 U.S.C. 154(b) by 0 days.

(21) Appl. No.: 09/259,363

(22) Filed: Feb. 26, 1999

(51) Int. Cl.[7] ..... E21B 37/08

(52) U.S. Cl. ..... 166/311; 166/63; 166/249; 181/0.5; 181/117

(58) Field of Search ..... 166/249, 299, 166/308, 63, 177.5, 177.6, 177.7, 311; 181/0.5, 117

(56) References Cited

U.S. PATENT DOCUMENTS

| | | | | |
|---|---|---|---|---|
| 3,638,752 | * | 2/1972 | Wakefield | 181/0.5 |
| 4,408,676 | * | 10/1983 | McCoy | 181/113 |
| 4,966,326 | | 10/1990 | Slez et al. . | |
| 5,297,631 | * | 3/1994 | Gipson | 166/299 |
| 5,579,845 | | 12/1996 | Jansen et al. . | |
| 5,836,393 | | 11/1998 | Johnson et al. . | |

OTHER PUBLICATIONS

Gavrilko, V.M. ; Alekseev, V.S. "Water well Screen"; Publishing House "NEDRA", pp. 300–304 Moscow.

* cited by examiner

*Primary Examiner*—William Neuder
(74) *Attorney, Agent, or Firm*—Lilling & Lilling P.C.

(57) ABSTRACT

A self-firing and self-propelling gas impulse device which includes a housing having a longitudinal axis, a gas inlet port, and one or more gas discharge ports; an inlet chamber, arranged for gas communication with a source of compressed gas via the inlet port and operative to receive compressed gas therefrom; a pressurization chamber arranged for gas communication with the inlet chamber thereby to facilitate a build-up of pressurized gas therein, and arranged for selectable gas communication with the one or more discharge ports; and a piston unit arranged along the longitudinal axis of the housing between the inlet chamber and the pressurization chamber. The piston unit is selectably movable between a first operative position and a second operative position, whereat in the first operative position the piston unit prevents gas communication between the pressurization chamber and the one or more discharge ports, and whereat in the second operative position the piston unit is retracted so as to facilitate gas communication between the pressurization chamber and the one or more discharge ports.

62 Claims, 16 Drawing Sheets

GAS IMPULSE DEVICE AND METHOD OF USE THEREOF

FIELD OF THE INVENTION

The present invention relates generally to the rehabilitation, stimulation, development and maintenance of oil and water wells, pipes, reservoirs, channels and the like, and in particular to the use of air or gas apparatus for achieving same.

BACKGROUND OF THE INVENTION

Among the variety of methods known in the art of oil and water well rehabilitation and maintenance, are methods which involve the use of chemical or explosive materials for the removal of hard deposits and other encrustations. Alternative methods known in the art employ high pressure jetting techniques in the well-cleaning process. Variations of these methods are also utilized for the cleaning and maintenance of other liquid or dry storage and transport facilities such as reservoirs, crucibles, tanks, pipelines and channels.

A consideration of cleaning processes which employ explosives for the removal of hard deposits and encrustations, raises a number of important concerns. Such concerns include safety issues surrounding the manufacture, transport, usage and storage of explosive material, as well as concerns regarding the risk of structural damage to a water or oil well, or other storage or transport facility undergoing treatment.

Turning now to cleaning methods involving the use of high pressure jetting—which by way of example, are employed to remove hard scale deposits from wells and pipelines—these methods involve the application of a high pressure jet, such as a water jet, to an area of deposits, so as to first penetrate and then "strip off" the deposits by driving a fluid wedge between them and the surface to which they are attached. Disadvantages surrounding this method include limited effectiveness owing to dissipation of hydraulic power which may result from line losses, activation of the jet in a liquid environment, and difficulties in controlling movement of the jet In addition to the above-described rehabilitation, cleaning and maintenance techniques, there are also known in the art, treatment methods which involve the use of air or gas blasting apparatus. U.S. Pat. No. 5,579,845 to Janson et al for example, entitled "Method for Improved Water Well Production", teaches generally, a method by which pressure waveforms and mass displacement within a well bore volume are used for stimulating, refurbishing or otherwise increasing production from water wells.

Referring now to U.S. Pat. No. 4,966,326, entitled "Air-Blasting Cartridge", there is described an example of air blasting apparatus which may be used for performing such treatment methods. This patent describes an air-blasting cartridge comprising a housing subdivided into an inlet chamber and a discharge chamber by virtue of a piston arranged lengthwise along a longitudinal axis of the housing. The inlet chamber communicates with a source of compressed air through an air admission tube which runs the length of the cartridge through an axial port of the piston. The discharge chamber communicates with the inlet chamber through an annular gap between the air admission tube and the piston, and is adapted to communicate with the surrounding atmosphere at the instant of its discharge, by means of at least one open-ended passage made in the housing close to the inlet chamber, wherein a pressure relief valve is provided at the outlet end of the passage.

While the above apparatus is intended for use in cleaning industrial pipelines including sewer pipelines, its efficiency especially with respect to well rehabilitation and maintenance—is limited by the very construction of the cartridge. In particular, the provision for the cartridge to communicate with the surrounding environment through the above-described pressure relief valve, creates a significant limitation upon the piston's opening speed which increases in accordance with the hydrostatic pressure. Further, the cartridge's pressure relief valves are likely to become clogged rather quickly, especially when the apparatus is used in a liquid environment containing an appreciable quantity of suspended particles.

SUMMARY OF THE INVENTION

The present invention seeks to provide improved apparatus, and an effective and environmentally friendly method, for water and oil well rehabilitation, stimulation, development and maintenance, which overcome the disadvantages of known art. The present invention also seeks to provide improved apparatus and method for the cleaning and maintenance of other liquid and dry storage and transport facilities.

There is thus provided, in accordance with a preferred embodiment of the invention, a self-firing and self-propelling gas impulse device which includes:

- a housing having a longitudinal axis, a gas inlet port, and one or more gas discharge ports;
- an inlet chamber, arranged for gas communication with a source of compressed gas via the inlet port and operative to receive compressed gas therefrom;
- a pressurization chamber arranged for gas communication with the inlet chamber thereby to facilitate a buildup of pressurized gas therein, and arranged for selectable gas communication with the one or more discharge ports; and
- a piston unit arranged along the longitudinal axis of the housing between the inlet chamber and the pressurization chamber, and selectably movable between a first operative position and a second operative position, whereat in the first operative position the piston unit prevents gas communication between the pressurization chamber and the one or more discharge ports, and whereat in the second operative position the piston unit is retracted so as to facilitate gas communication between the pressurization chamber and the one or more discharge ports, and the piston unit is operative to move between the first and the second operative positions in response to a force differential across the piston unit in a direction parallel to the longitudinal axis, such that when the piston unit is in the first operative position and the gas pressure in the pressurization chamber is of at least a predetermined magnitude, the piston unit is operative to move towards the second operative position in response to the gas pressure and at least a predetermined minimum force differential thereby to facilitate a rapid high pressure exhaustion of gas in the pressurization chamber to the exterior of the housing via the one or more discharge ports.

Additionally, in accordance with a preferred embodiment of the present invention, at least a portion of the piston unit is operative to move within a sealing arrangement such that when the piston unit is in the first operative position, the sealing arrangement and the piston unit cooperate so as to prevent gas communication between the pressurization chamber and the one or more discharge ports.

Further, in accordance with a preferred embodiment of the present invention, the inlet port is formed at an upstream end of the gas impulse device, and the pressurization chamber is formed at a downstream end of the gas impulse device.

Additionally, in accordance with a preferred embodiment of the present invention, the piston unit includes an upstream-facing end portion having an upstream-facing end surface and a downstream-facing end portion having a downstream-facing end surface.

Further, in accordance with a preferred embodiment of the present invention, when the piston unit is in the first operative position, the inlet chamber is operative to contain a gas having a pressure of up to a first magnitude and the pressurization chamber is operative to contain a gas having a pressure of up to a second magnitude, and when the upstream-facing end surface is exposed to the gas pressure of the first magnitude a first force is developed thereat, and when the downstream-facing end surface is exposed to the gas pressure of the second magnitude a second force is developed thereat, and the predetermined minimum force differential corresponds to the difference in the respective magnitudes between the first and second forces.

Additionally, in accordance with a preferred embodiment of the present invention, the predetermined minimum force differential is related to the ratio between the first and second gas pressure magnitudes and the ratio between the areas of the end surfaces.

Further, in accordance with a preferred embodiment of the present invention, the first operative position includes a first extreme position and the second operative position includes a second extreme position and the movement of the piston unit towards the second operative position in response to the gas pressure and the predetermined minimum force differential, includes a movement of the piston unit towards the second extreme position.

Additionally, in accordance with a preferred embodiment of the present invention, the piston unit includes an upstream-facing end portion having an upstream-facing end surface and a downstream-facing end portion having a downstream-facing end surface, and the movement of the piston unit towards the second operative position in response to the gas pressure and the predetermined minimum force differential is a first movement of the piston unit out of the sealing arrangement, and the piston unit has a further downstream-facing surface such that upon the piston unit moving out of the sealing arrangement, the further downstream-facing surface suddenly becomes exposed to the pressurized gas within the pressurization chamber, thereby to cause the piston unit to rapidly move towards the second extreme position in a second movement and so as to cause the rapid high pressure exhaustion of gas.

Further, in accordance with a preferred embodiment of the present invention, the device includes a variable-sized discharge chamber arranged between the pressurization chamber and the one or more discharge ports such that when the piston unit is in the first operative position, the sealing arrangement and the piston unit cooperate so as to prevent gas communication between the pressurization chamber and the discharge chamber, and the discharge chamber increases in size as the piston unit moves from the first extreme position towards the second extreme position, and the rapid high pressure exhaustion of gas from the pressurization chamber to the exterior of the housing is also via the discharge chamber.

Additionally, in accordance with a preferred embodiment of the present invention, the portion of the piston unit is a first portion of the piston unit and the sealing arrangement is a first sealing arrangement, and the gas impulse device also includes a second sealing arrangement.

Further, in accordance with a preferred embodiment of the present invention, the device also includes a variable-sized damper chamber arranged between a second portion of the piston unit and the second sealing arrangement such that when the piston unit moves from the first extreme position towards the second extreme position, the damper chamber decreases in size thereby to increase the pressure therein so as to apply a damping force to the piston unit.

Additionally, in accordance with a preferred embodiment of the present invention, the pressurization chamber communicates with the inlet chamber via a generally cylindrical passage which extends through the piston unit.

Alternatively, in accordance with another embodiment of the present invention, the inlet chamber communicates with the inlet port via an air admission conduit which extends through the piston unit.

Additionally, in accordance with the other embodiment of the present invention, the pressurization chamber communicates with the inlet chamber via an annular gap arranged between a generally cylindrical inner surface of the piston unit and a generally cylindrical outer surface of the air admission conduit.

Further, in accordance with a preferred embodiment of the present invention, the device includes apparatus for controlling the supply of gas to the inlet chamber.

Additionally, in accordance with a preferred embodiment of the present invention, the inlet chamber is configured for gas communication with the inlet chamber of another gas impulse device thereby to enable the controlled supply of gas to a plurality of interconnected gas impulse devices.

Further, in accordance with a preferred embodiment of the present invention, the one or more discharge ports broadens as they extend towards the exterior of the housing.

Additionally, in accordance with one embodiment of the present invention, the one or more discharge ports are arranged transverse to the longitudinal axis of the housing.

Alternatively, in accordance with another embodiment of the present invention, the one or more discharge ports are arranged at an angle less than ninety degrees with respect to the longitudinal axis of the housing.

There is also provided in accordance with an another preferred embodiment of the invention, a method of rehabilitating a container, having therein a liquid and having a wall construction the wall construction having thereon undesired substances sought to be removed, wherein the method includes:

positioning within the liquid a gas impulse device in an orientation generally parallel to a portion of the wall construction to be rehabilitated; and operating the gas impulse device so as to repeatedly discharge cleaning jets of a predetermined gas towards the portion of the wall construction, thereby to separate the undesired substances therefrom, and thereby also to propel the gas impulse device along a travel path generally parallel to the portion of the wall construction thus to deliver successive cleaning jets to successive portions of the wall construction.

Additionally, in accordance with the other preferred embodiment of the present invention, the step of operating the gas impulse device includes the step of selectably supplying compressed gas to the gas impulse device, including selectably releasing compressed gas from the gas impulse device.

Further, in accordance with the other preferred embodiment of the present invention, the step of operating the gas impulse device includes supplying to the gas impulse device a compressed gas whose main component is selected from the group consisting of:

(i) air, and (ii) nitrogen.

Alternatively, in accordance with the other preferred embodiment of the present invention, the step of operating the gas impulse device includes supplying to the gas impulse device a compressed gas whose main component is carbon dioxide, so as to give rise to the formation of carbonic acid upon operation of the device.

Optionally, in accordance with the other preferred embodiment of the present invention, the method includes the step of introducing a chemical compound into the liquid prior to the step of operating the gas impulse device, so as to give rise to a chemical reaction of the chemical compound with the undesired substances.

In accordance with the yet another preferred embodiment of the present invention, the container is a well and the step of operating the gas impulse device causes an increase in pressure in the well, and the method also includes the step of packing at least a region of the well prior to the step of operating the gas impulse device, so as to limit liquid displacement in the packed region and to substantially maintain the pressure increase therein during the step of operating the gas impulse device.

Optionally, in accordance with the other preferred embodiment of the present invention, the method includes the step of releasing excess pressure from the packed region of the well so as to prevent an increase of pressure within the well of greater than a predetermined magnitude.

Additionally, in accordance with one embodiment of the present invention where the wall construction includes a rock formation containing a liquid flow, the method may include the step of causing a continued increase in pressure within the packed region of the well, such that the step of operating the gas impulse device is operative to cause fracturing of a portion of the rock formation, thereby to improve a liquid flow therefrom into the well.

Further, in accordance with another embodiment of the present invention, the method includes the step of introducing a proppant into the well prior to the step of operating the gas impulse device, thereby to support fractures within the outer rock formation upon operation of the gas impulse device.

There is also provided in accordance with yet another embodiment of the invention, a method of rehabilitating a container, having therein a liquid and having a wall construction the wall construction having thereon undesired substances sought to be removed, wherein the method includes:

positioning in the container a gas impulse device in an orientation generally parallel to a portion of the wall construction to be rehabilitated; and supplying a predetermined gas to the gas impulse device so as to provide a blast of gas in the form of a jet directed towards the wall construction, so as to separate the undesired substances therefrom.

Additionally, in accordance with the other embodiment of the present invention, the method includes repeating the step of supplying a predetermined gas to the gas impulse device so as to provide further blasts of gas in the form of jets directed towards the wall construction.

There is also provided in accordance with yet a further embodiment of the invention, a method of rehabilitating a well, having therein a liquid and having a well screen the well screen having thereon undesired substances sought to be removed, wherein the method includes:

positioning within the liquid a gas impulse device in an orientation generally parallel to a portion of the well screen to be rehabilitated; and operating the gas impulse device so as to repeatedly discharge cleaning jets of a predetermined gas towards the portion of the well screen, thereby to separate the undesired substances therefrom, and thereby also to propel the gas impulse device along a travel path generally parallel to the portion of the well screen thus to deliver successive cleaning jets to successive portions of the well screen.

There is also provided in accordance with yet another embodiment of the invention, a method of rehabilitating a well, having therein a liquid and having a well screen the well screen having thereon undesired substances sought to be removed, wherein the method includes:

positioning in the well a gas impulse device in an orientation generally parallel to a portion of the well screen to be rehabilitated; and supplying a predetermined gas to the gas impulse device so as to provide a blast of gas in the form of a jet directed towards the well screen, so as to separate the undesired substances therefrom.

Additionally, in accordance with the other embodiment of the present invention, the method includes repeating the step of supplying a predetermined gas to the gas impulse device so as to provide further blasts of gas in the form of jets directed towards the well screen.

BRIEF DESCRIPTION OF THE DRAWINGS

The present invention will be more fully understood and appreciated from the following detailed description, taken in conjunction with the drawings, in which.

DETAILED DESCRIPTION OF THE INVENTION

Figure 7:
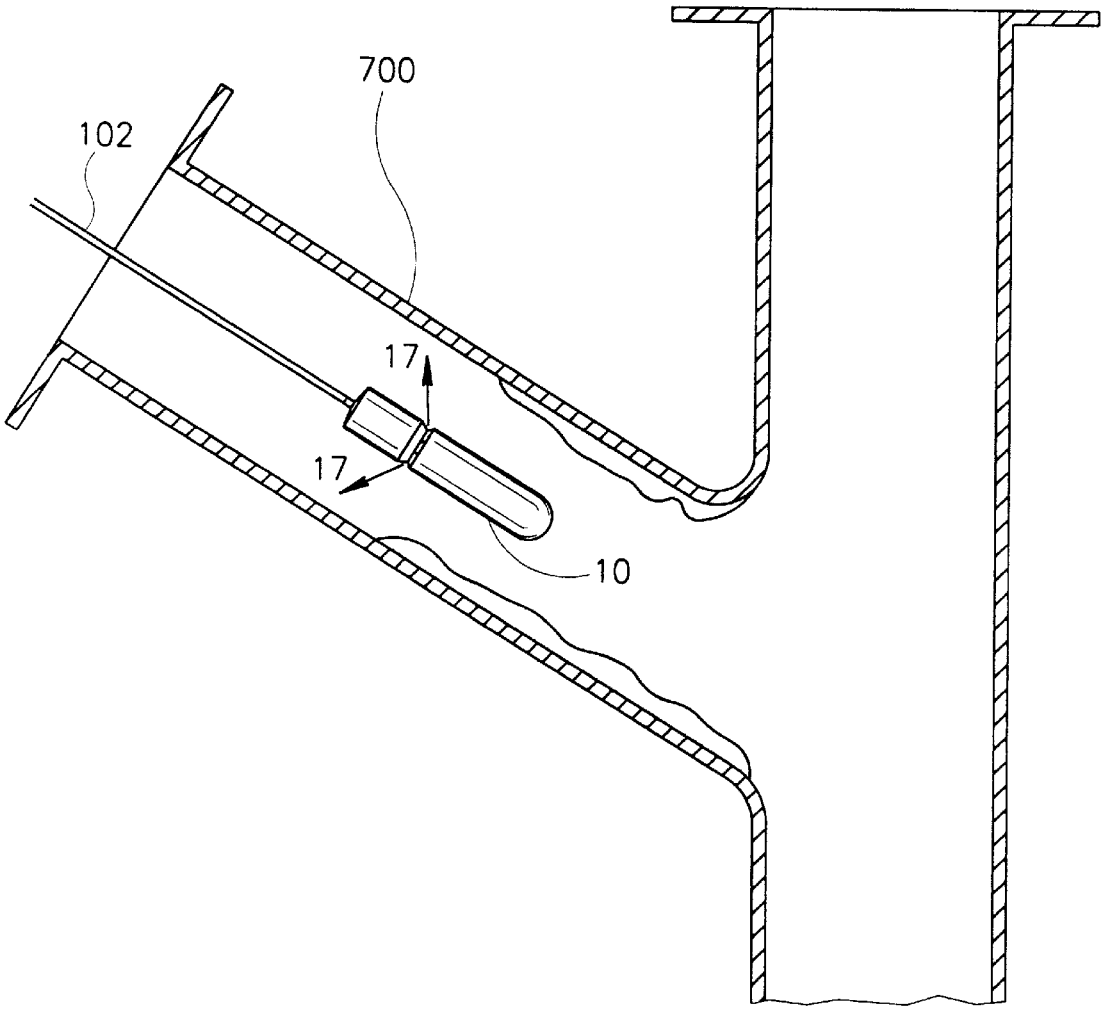
FIG. 7 is a schematic illustration of the gas impulse device of FIGS. 1–4 inserted for use in a pipeline.

The description set out hereinbelow relates to apparatus and method used in the rehabilitation, stimulation, development and maintenance of water and oil wells. It will be appreciated however, that while the description refers generally to water and oil wells, the described apparatus and method may be easily modified for application to the cleaning and maintenance of pipelines, channels, reservoirs, bins, crucibles and other similar liquid or dry storage and transport facilities, some of which are described herein in conjunction with FIGS. 7–9.

Referring generally to FIGS. 1–4 and 7–15, there is seen a rapid self-firing, self-propelling gas impulse device, referenced 10, constructed and arranged in accordance with a preferred embodiment of the invention. When operated in accordance with a related method of the invention as described hereinbelow, device 10 produces impulses or "blasts" of gas which are operative to apply forces to a surrounding area of the well, storage or transport facility within which the device is being operated, so as to effectively dislodge deposits therefrom. Additionally, in accordance with the present embodiment, the impulse forces produced by the gas impulse apparatus, are further operative to propel device 10 along a predetermined course so as to enable repeated firing within contiguous portions of the facility undergoing treatment In use, device 10 is typically operable under pressures of up to 400 atmospheres in the case of oil wells, and up to 200 atmospheres in the case of water wells. Further, device 10 is constructed to operate effectively in any of a multiplicity of orientations such that it may be used for cleaning vertical, horizontal and inclined wells and pipelines as described hereinbelow in conjunction with FIG. 1 and FIGS. 7–9.

Figure 1:
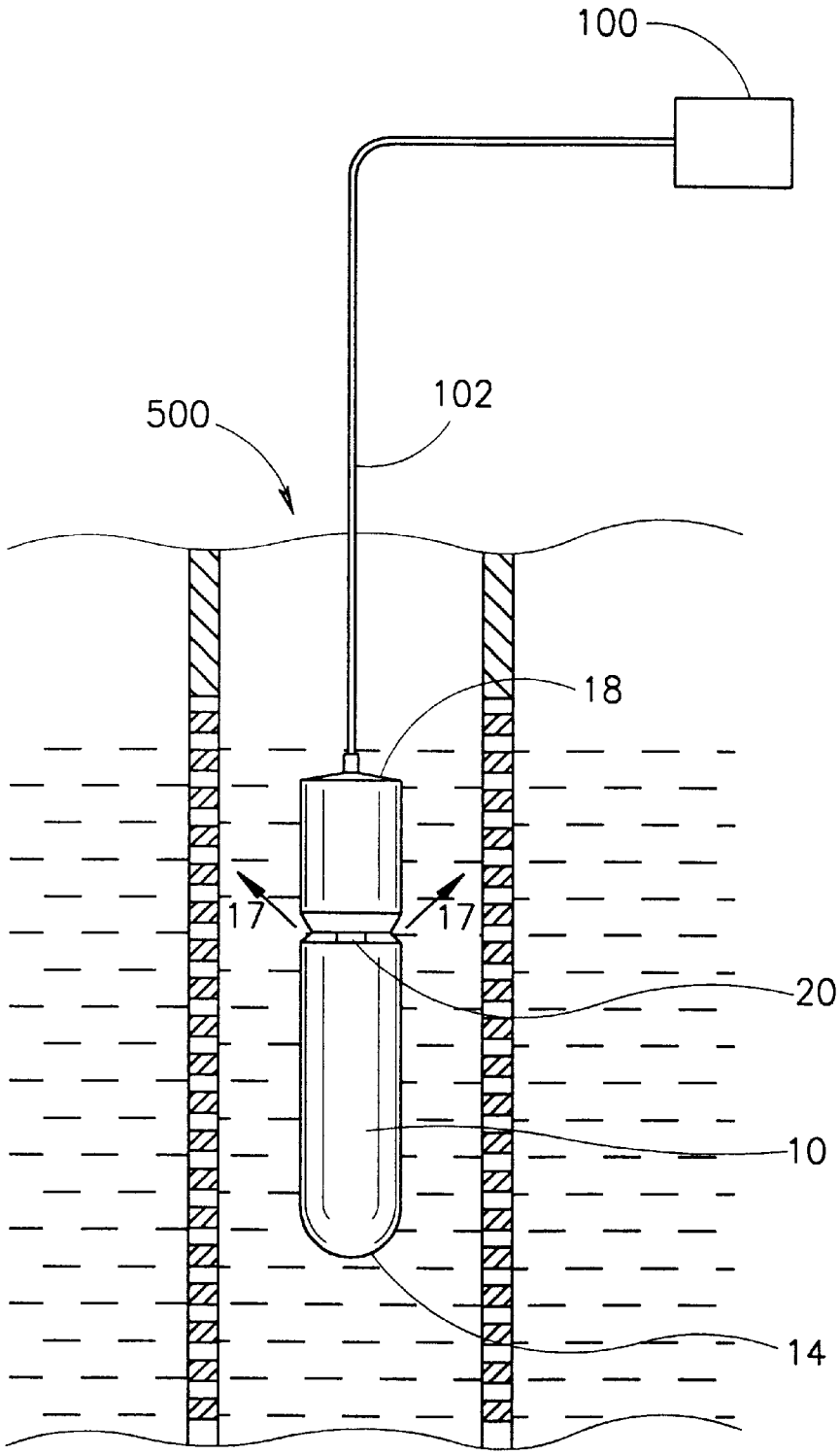
FIG. 1 is a schematic illustration of a gas impulse device constructed in accordance with a preferred embodiment of the present invention, connected to an external pressurized gas source by means of a high pressure supply conduit, and inserted for use in a water well.
Figure 2:
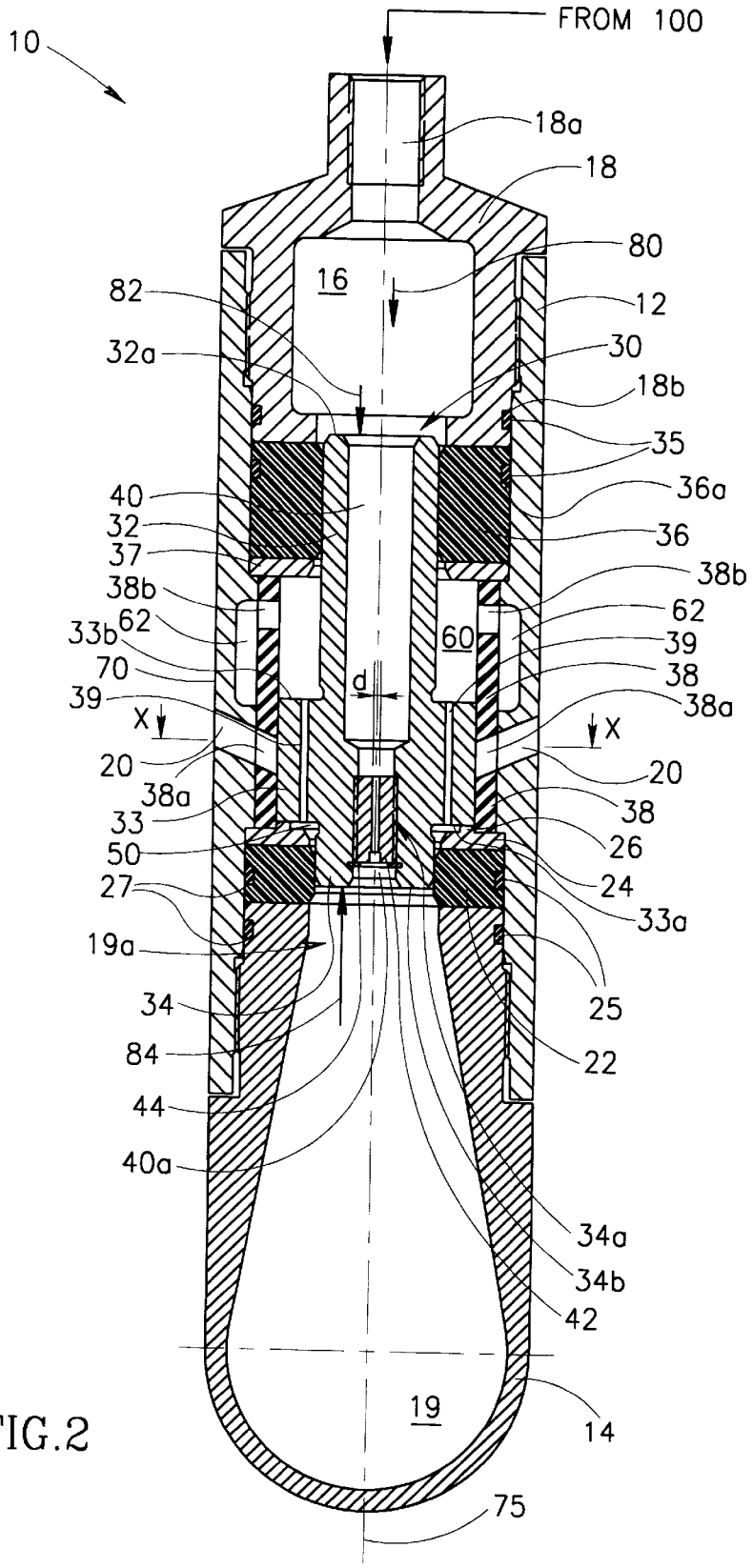
FIG. 2 is an axial sectional view of a gas impulse device constructed in accordance with a preferred embodiment of the present invention, illustrating the device's piston unit in a first extreme position prior to firing of the device, whereat the piston unit is operative to seal the pressurization chamber from the device's discharge ports.
Figure 3:
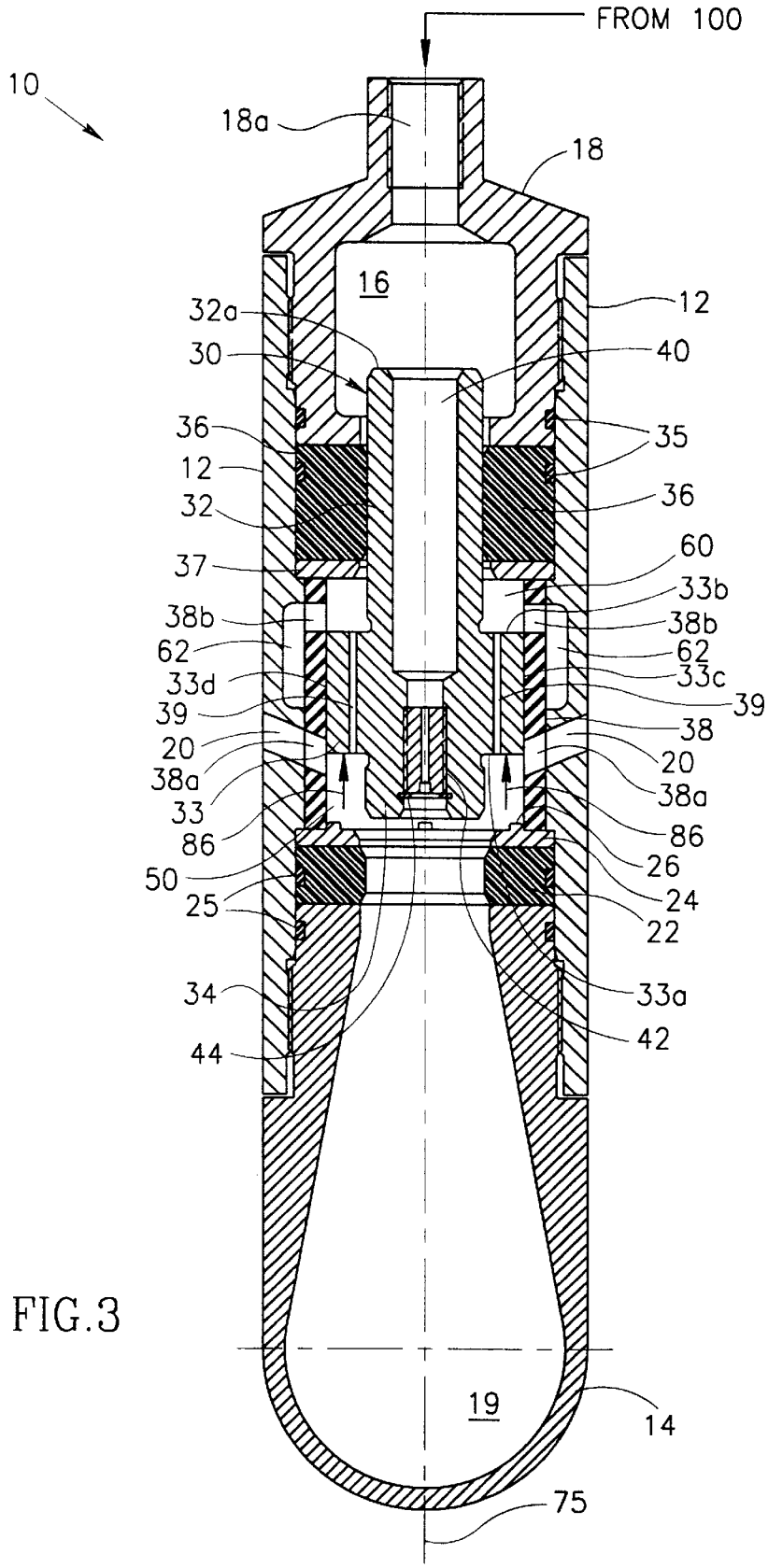
FIG. 3 is a view similar to that of FIG. 2, illustrating an upstream traversal of the device's piston unit, thereby allowing for gas communication between the device's pressurization chamber and discharge ports so as to create a gas blast.
Figure 4:
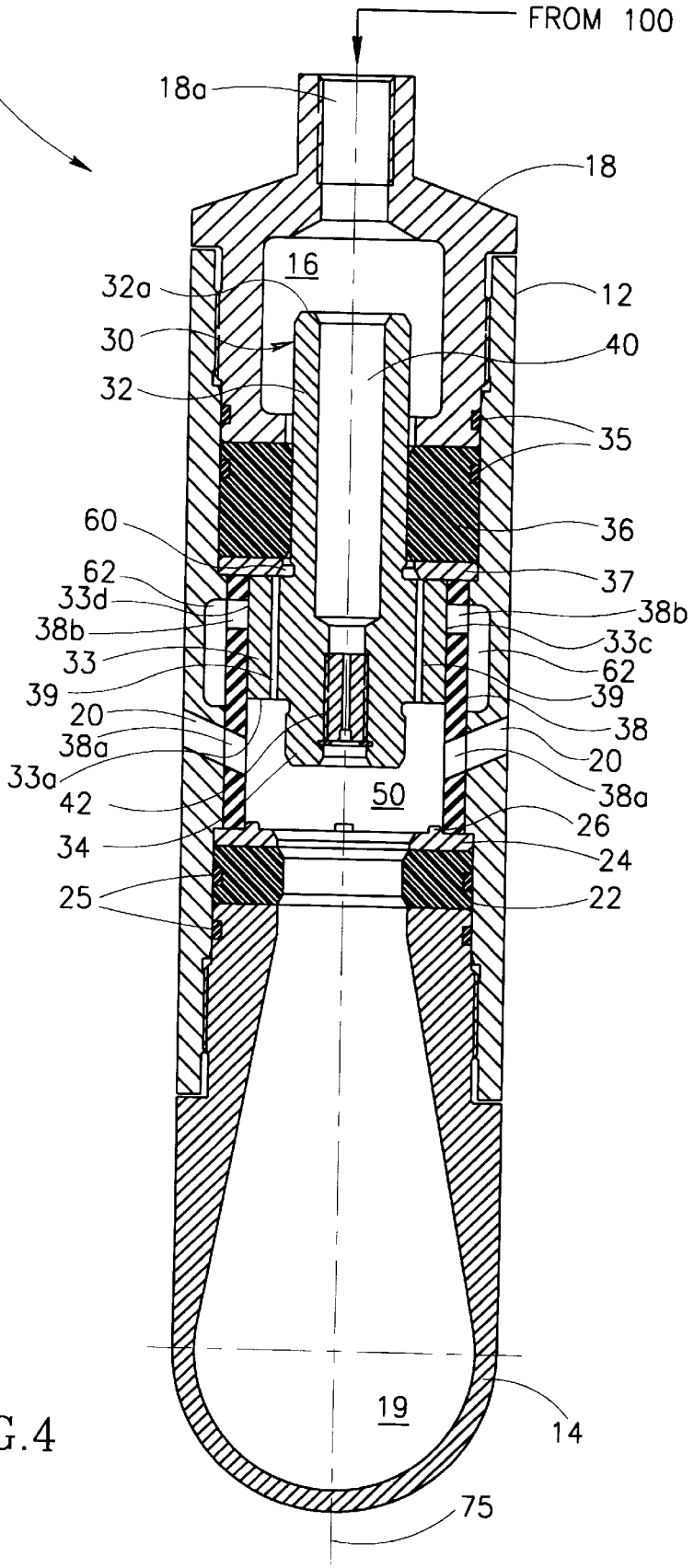
FIG. 4 is a view similar to that of FIGS. 2 and 3, illustrating the device's piston unit in a second extreme position subsequent to firing of the device.

Referring more particularly to FIGS. 2–4, gas impulse device 10 preferably has a cylindrical housing 12 which houses a gas receiving unit 14 at one end, and an inlet chamber 16 formed within an end cap 18 at the other end. During operation of the device, inlet chamber 16 receives pressurized gas—such as compressed air, nitrogen or carbon dioxide—from an external pressurized gas source 100 (FIG. 1), through an inlet port 18*a* formed in end cap 18, whereafter the gas transfers to gas receiving unit 14 so as to ultimately cause the device's piston unit, referenced 30, to be activated as described hereinbelow. Upon activation of piston unit 30, pressurized gas is released through discharge ports 20, and creates a gas blast illustrated by arrows 17 of FIG. 1. As noted above, the gas blast created by device 10 is operative to dislodge deposits from selected portions of the well, as well as to provide a jet force for propelling the apparatus along a predetermined course.

Figure 2A:
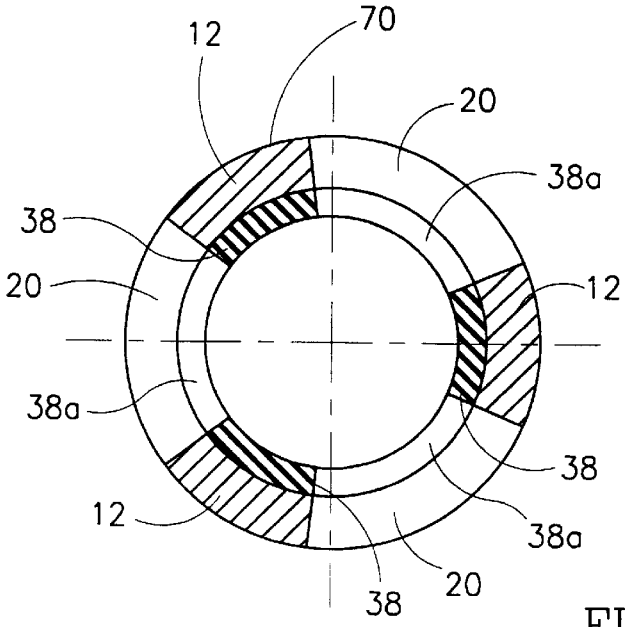
FIG. 2A is a cross-sectional view taken along the line X—X of FIG. 2 depicting the gas impulse device's cylindrical housing and piston guide only.

It is noted that the configuration and orientation of discharge ports 20 play a significant role in determining the efficacy of the gas blast provided by gas impulse device 10. In a preferred embodiment of the invention as illustrated in FIGS. 2–4, discharge ports 20 broaden laterally as they extend towards perimeter, 70, of cylindrical housing 12 (FIG. 2A) so as to form Laval-type nozzles. Discharge ports 20 are preferably also angled between 45° to 90° with respect to a longitudinal axis, 75, of cylindrical housing 12. This combination of broadening and angled discharge ports 20, enhances both the velocity of the gas released during a gas blast, and provides for an effective jet force in the propulsion of device 10. It is noted however, that the invention is not intended to be limited by the configurations of discharge ports 20 as described, and alternative embodiments may well include, for example, discharge ports arranged laterally with respect to axis 75, such as in cases where it is desirable not to provide a jet force during operation of the apparatus.

Prior to commencing a detailed consideration of the various components of gas impulse device 10, it is noted that for purposes of convenience, gas receiving unit 14 is considered in the description below as being located downstream with respect to inlet chamber 16 and end cap 18. Furthermore, references to "firing" of the apparatus, relate to the creation of a gas blast by means of releasing pressurized gas through discharge ports 20 as described hereinbelow.

Figure 2B:
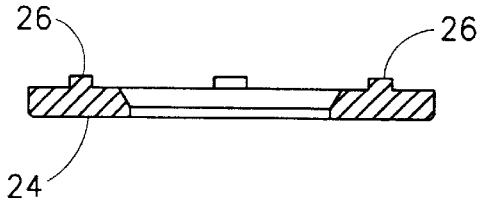
FIGS. 2B and 2C are respective side and plan views of the gas impulse device's first ring element.
Figure 2C:
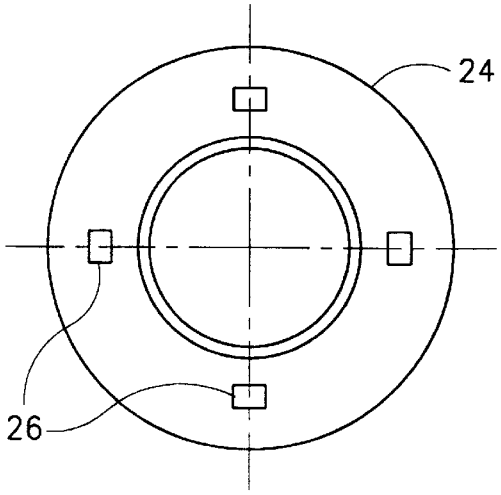

Considering now gas receiving unit 14 in more detail, there is seen provided therein, a conical, longitudinally extending, gas receiving or pressurization chamber, referenced 19, which is operative to hold a charge of high pressured gas. Located upstream of a narrowing upstream portion 19*a* (FIG. 2) of chamber 19, is a first damper ring 22 which is preferably formed of a durable, elastic material such as a high density polyethylene material, and which serves as both an energy damping element and a sealing element. In a preferred embodiment of the invention, first damper ring 22 is coupled with a first ring element 24 such as a steel ring, which has formed on an upstream-facing surface thereof, lugs 26 which act as spacers (also seen in FIGS. 2B and 2C). First ring element 24 is operative to protect first damper ring 22 from damage during operation of device 10. There are also provided O-ring seals 25, mounted inside grooves 27 (FIG. 2) formed within gas receiving unit 14 and first damper ring 22. O-ring seals 25 function to seal the area of contact between cylindrical housing 12 and gas receiving unit 14, as well as the area of contact between cylindrical housing 12 and first damper ring 22.

Referring still to FIGS. 2–4, piston unit 30 is seen to be arranged within cylindrical housing 12, so as to lie in coaxial alignment with axis 75 of the cylindrical housing. During operation of device 10, piston unit 30 moves between a first extreme position (FIG. 2) and a second extreme position (FIG. 4), thereby closing and opening discharge ports 20 to the release of pressurized gas.

Piston unit 30 is typically formed of toughened stainless steel and has three integrally formed sub-units—namely: a longitudinally arranged piston body 32, a piston head 33, and a piston nose 34. As illustrated in FIGS. 2–4, piston body 32 is movably positioned inside a second damper ring 36 and adjacently positioned second ring element 37, whilst piston nose 34 is configured for entry into first damper ring 22 and first ring element 24 when the piston unit assumes its first extreme position prior to firing of the impulse device (FIG. 2). In a preferred embodiment of the invention, second damper ring 36 is formed generally similar to but somewhat longer than first damper ring 22, whilst second ring element 37 is formed generally similar to first ring element 24 but does not possess lugs.

In addition to serving as an energy damping element and a sealing element, second damper ring 36 also functions as a guide element for piston body 32. Additionally, O-ring seals referenced 35, are mounted within grooves 18*b* of end cap 18, and 36*a* of second damper ring 36, so as to seal the areas of contact between end cap 18 and cylindrical housing 12, and second damper ring 36 and cylindrical housing 12, respectively.

There is also provided a sleeve-shaped piston guide 38, which is concentrically arranged around piston head 33, and which is operative to guide the piston head as piston unit 30 moves between its extreme first and second positions. Piston guide 38 is typically formed from a durable, corrosion-resistant material such as a polyamide or bronze based material. First openings within the piston guide, referenced 38*a,* are arranged adjacent to discharge ports 20, so as to enable the exit of pressurized gas upon the firing of device 10.

Referring still to piston unit 30, there is seen in FIGS. 2–4, a longitudinal passage 40, which axially extends through an inner hollow of the piston unit. Passage 40 is arranged such that it is contiguous with inlet chamber 16, and provides for gas communication between the inlet chamber and pressurization chamber 19. There is also provided, an orifice element 42, which is threadedly attached to an inner portion 34*a* (FIG. 2) of piston nose 34, and which is prevented from exiting a downstream end 40*a* of passage 40 by means of a stopper ring 44.

In addition to inlet chamber 16 and pressurization chamber 19, gas impulse device 10 includes two further chambers, referenced herein as discharge chamber 50 and damper chamber 60. As illustrated in FIGS. 2–4, the configurations of discharge chamber 50 and damper chamber 60 vary in accordance with the position of piston unit 30 at a given point in time during operation of the apparatus. As seen particularly in FIG. 3, discharge chamber 50 provides for the throughflow of pressurized gas from pressurization chamber 19 to discharge ports 20, following the withdrawal of piston nose 34 from first damper ring 22 and first ring element 24 in the course of piston unit 30 moving upstream towards its second extreme position (FIG. 4). Also seen in FIG. 3, is a cylindrical shaped cavity, referenced 62, formed within cylindrical housing 12, and arranged for gas communication with damper chamber 60 via second openings 38*b* of piston guide 38. Further, there is also formed within piston head 33, at least one preferably narrow bore which allows for further gas communication between discharge chamber 50 and damper chamber 60 during the operation of device 10. FIGS. 2–4 illustrate two such bores, referenced 39.

Referring still to FIGS. 2–4, operation of gas impulse device 10 in performing a method of the invention, is now described.

Initially, compressed gas is fed from a high pressure external gas source 100 (FIG. 1) to inlet chamber 16 via a suitable high pressure supply conduit 102 (FIG. 1) which is attached to end cap 18. The compressed gas entering inlet chamber 16 via inlet port 18*a,* flows downstream in a direction indicated by arrow 80 (FIG. 2), such that it enters passage 40 of piston unit 30. Once the pressure within inlet chamber 16 reaches a predetermined magnitude, the continued supply of compressed gas causes the gas to flow into pressurization chamber 19 via orifice element 42, which because of its narrow internal diameter, d, (FIG. 2) has a limiting effect upon the rate at which the compressed gas passes through to the pressurization chamber. At the same time, the pressure within inlet chamber 16 results in the application of a force of compressed gas to an upstream annular end surface 32*a* of piston body 32, as indicated by arrow 82 (FIG. 2).

In cases where the operation of device 10 commences while piston unit 30 is positioned upstream of its first extreme position (FIG. 2), the above-described force causes a downstream movement of piston unit 30 relative to pressurization chamber 19, after which piston nose 34 is seen to be fully engaged with first ring element 24 and first damper ring 22 as illustrated in FIG. 2. In this position, a generally annular, downstream-facing first shoulder 33*a* of piston head 33 is seen to abut lugs 26 of first ring element 24 such that discharge chamber 50 assumes a small, generally annular volume between the adjacent surfaces of piston head 33, piston nose 34, and first ring element 24.

Referring still to FIG. 2, it is seen that the above-described downstream traversal of piston head 33 causes discharge ports 20 to become blocked off from the compressed gas contained within the various chambers of impulse device 10. Furthermore, the entry of piston nose 34 into first damper ring 22, creates a seal between pressurization chamber 19 and discharge chamber 50. In this position, bores 39 provide for gas communication between discharge chamber 50 and damper chamber 60 thereby maintaining equal pressure within those chambers. Since, in a preferred embodiment of the invention, there is only a very small difference between the surface areas of first piston head shoulder 33*a* and an upstream-facing second piston head shoulder 33*b*, the respective forces applied to these shoulder surfaces are effectively balanced.

Following the full entry of piston nose 34 into first damper ring 22 as described, the additional feeding of compressed gas into device 10 creates an increase in pressure within pressurization chamber 19. This increase in pressure, causes an increasing force to be applied to an end surface 34*b* of piston nose 34 as indicated by arrow 84 of FIG. 2. Once the force applied to end surface 34*b* exceeds the sum of the force applied to end surface 32*a* and the frictional forces arising between damper rings 22, 36, piston guide 38, and adjacent surfaces of piston unit 30, the piston unit will begin to move towards inlet chamber 16. It is noted that in a preferred embodiment of the invention—wherein the area of end surface 34*b* is greater than the area of end surface 32*a*—the pressure in pressurization chamber 19 required to initiate an upstream traversal of piston 30 towards inlet chamber 16, may be less than the magnitude of pressure within the inlet chamber.

As piston unit 30 commences its traversal towards inlet chamber 16, the resulting withdrawal of piston nose 34 from first damper ring 22 and first ring element 24, exposes shoulder 33*a* of piston head 33 to the gas pressure within pressurization chamber 19, such that an additional force is suddenly applied to shoulder 33*a* as indicated by arrows 86 of FIG. 3. Thus, the initial upstream movement of piston unit 30, leads to a sudden increase in the force applied to the downstream-facing surfaces of the piston unit, thereby causing a sudden, rapid movement of the piston unit towards inlet chamber 16.

Referring now to FIGS. 3 and 4 together, it can be seen that the rapid upstream traversal of piston unit 30 as described, causes an instantaneous opening of discharge ports 20, which in turn provides for a rapid discharge of pressurized gas from pressurization chamber 19 into the surrounding environment. It is this rapid discharge of pressurized gas which produces the gas blast depicted by arrows 17 in FIGS. 1 and 7–9.

It may also be seen from FIGS. 3 and 4, that as piston unit 30 continues its upstream movement towards inlet chamber 16, the inner dimensions of discharge chamber 50 increase in size thereby providing an enlarged passage for pressurized gas to flow from chamber 19 to ports 20. At the same time, damper chamber 60 decreases in size until it becomes a small annular volume, formed between piston unit 30 and second ring element 37 (FIG. 4).

FIGS. 3 and 4 further illustrate that as piston head 33 moves rapidly upstream so as to open discharge ports 20, side facing surfaces 33*c* and 33*d* of the piston head abruptly disconnect cavity 62 from the contracting damper chamber 60. While some of the gas contained within damper chamber 60 transfers to chamber 50 via bores 39, the sudden blocking-off of cylindrical cavity 62 sharply increases the pressure in damper chamber 60 thereby creating a compressed gas layer (not seen) between upstream-facing shoulder 33*b* of piston head 33 and second ring element 37. This compressed gas layer functions to provide a damping effect for the rapidly traversing piston unit 30.

Furthermore, owing to the decrease in pressure within chamber 19 upon the release of pressurized gas via discharge ports 20, and the increased pressure in both damper chamber 60 and inlet chamber 16, the respective forces applied to shoulder 33*b* of piston head 33 and end surface 32*a* of piston body 32, cause piston unit 30 to move rapidly back to its initial "pre-firing" position (FIG. 2).

It will be appreciated that in practice, the entire firing cycle described above is rapidly repeated by continuing the supply of compressed gas to inlet chamber 16. Typically, gas impulse device 10 is capable of firing at an approximate rate of up to 3.0 gas blasts per second. Once a desired number of firing cycles has been achieved, operation of the apparatus may be terminated by ceasing the supply of compressed gas to inlet chamber 16. Device 10 may then be removed from the subject well, pipe, or reservoir for subsequent use.

Figure 5A:
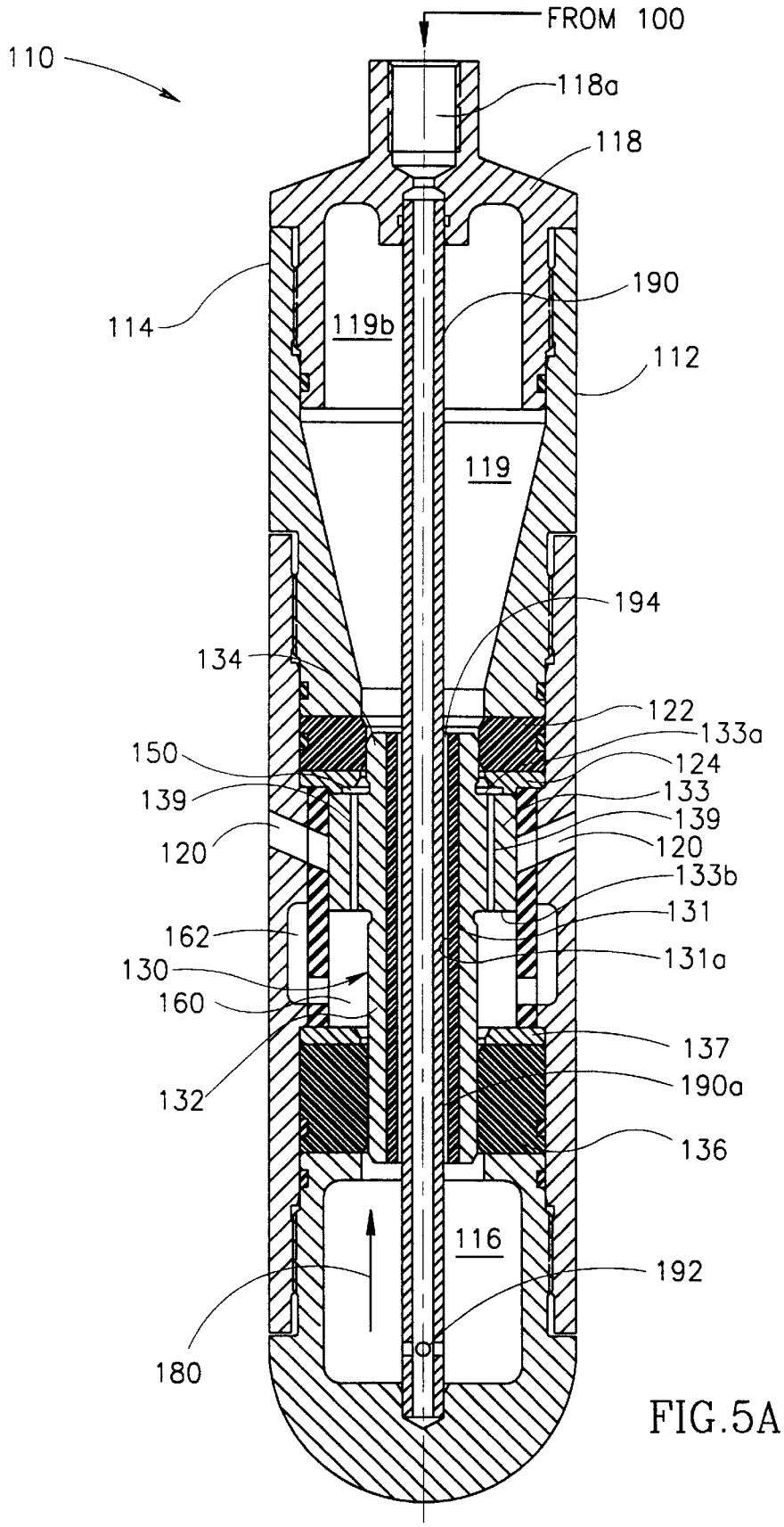
FIGS. 5A and 5B are axial sectional views of a gas impulse device constructed in accordance with an alternative embodiment of the present invention, and respectively illustrating first and second extreme positions of the device's piston unit, corresponding to extreme positions of the piston unit prior to and subsequent to firing of the device.
Figure 5B:
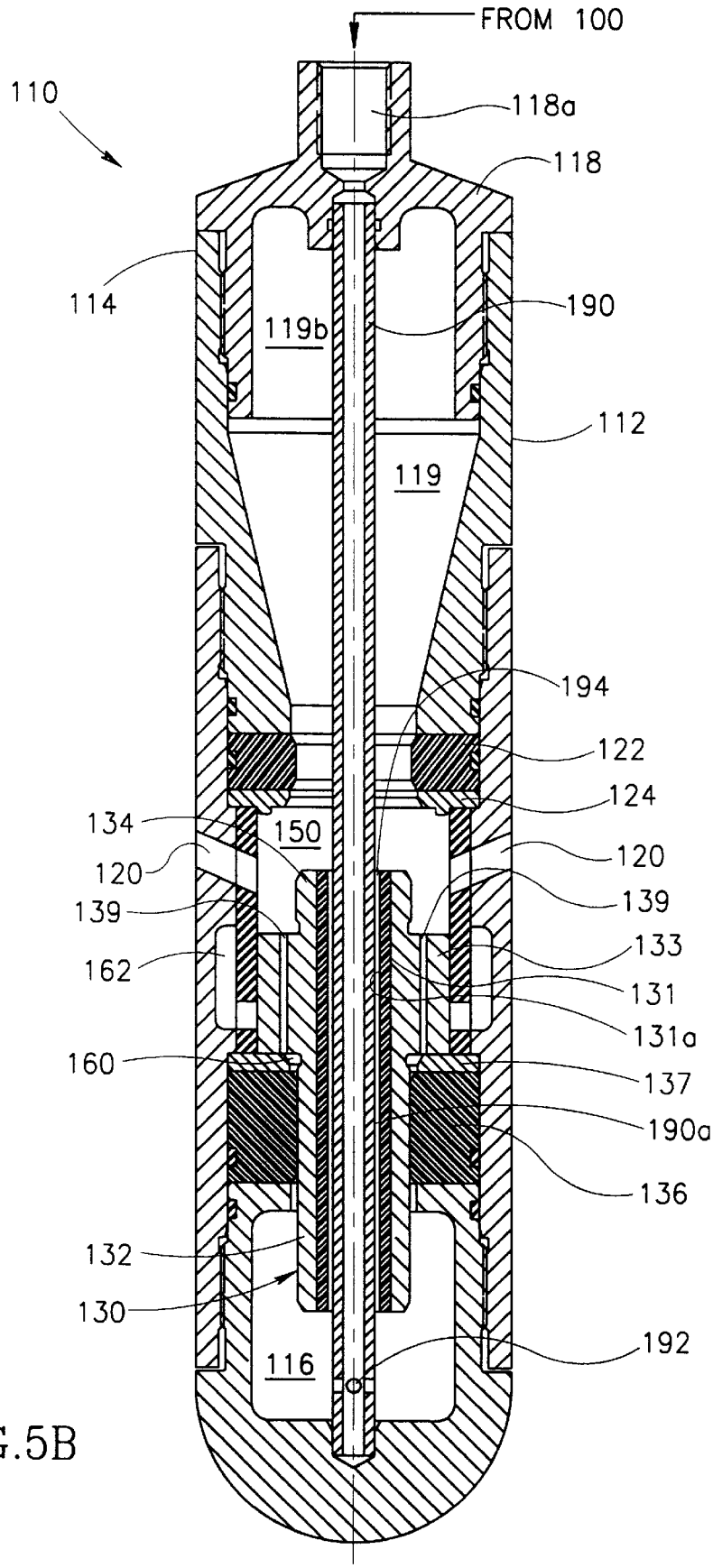

Turning now to FIGS. 5A and 5B, there is seen a gas impulse device, referenced 110, which is constructed and arranged in accordance with an alternative embodiment of the invention. Like the previously described embodiment, gas impulse device 110 is a self-firing, self-propelling device, and incorporates all the basic features of gas impulse device 10 described above. By way of contrast to device 10, however, inlet chamber 116 is arranged distally to end cap 118, while gas receiving unit 114 is arranged adjacent to end cap 118 such that a downstream portion 119*b* of pressurization chamber 119 is housed within the end cap. For purposes of clarity, various components of device 10 which are incorporated into device 110, are depicted in FIGS. 5A and 5B with similar reference numerals to those of FIGS. 2–4, but with the addition of a prefix "1".

As illustrated in FIGS. 5A and 5B, inlet chamber 116 is configured to receive compressed gas (not shown) from external source 100 and supply conduit 102 (FIG. 1) via an air admission tube 190 connected to inlet port 118*a*. Tube 190 is typically arranged such that it axially extends through the device's piston unit, referenced 130. A cylindrical sleeve 131, which is preferably formed of a flexible elastic material such as high density polyethylene, typically defines the inner surface of piston unit 130.

During operation of the invention, compressed gas received from gas source 100 (FIG. 1) enters inlet chamber 116 via an outlet port 192 of tube 190. Thereafter, the incoming gas flows to pressurization chamber 119 in a direction indicated by arrow 180, via a cylindrical gap 194 formed between an outer surface 190*a* of tube 190, and an inner surface 131*a* of piston sleeve 131.

Aside from the above-mentioned constructional and operational differences between devices 10 and 110, gas impulse device 110 is operative to produce a gas blast in a generally similar manner to gas impulse device 10; i.e. via the successive rapid movement of piston unit 130 between a first "pre-firing" position (FIG. 5A) and a second "post-firing" position (FIG. 5B). This rapid movement of piston unit 130 successively closes and opens discharge ports 120 to the release of pressurized gas from pressurization chamber 119, in generally the same manner as is described hereinabove in relation to the corresponding components of gas impulse device 10.

Figure 6:
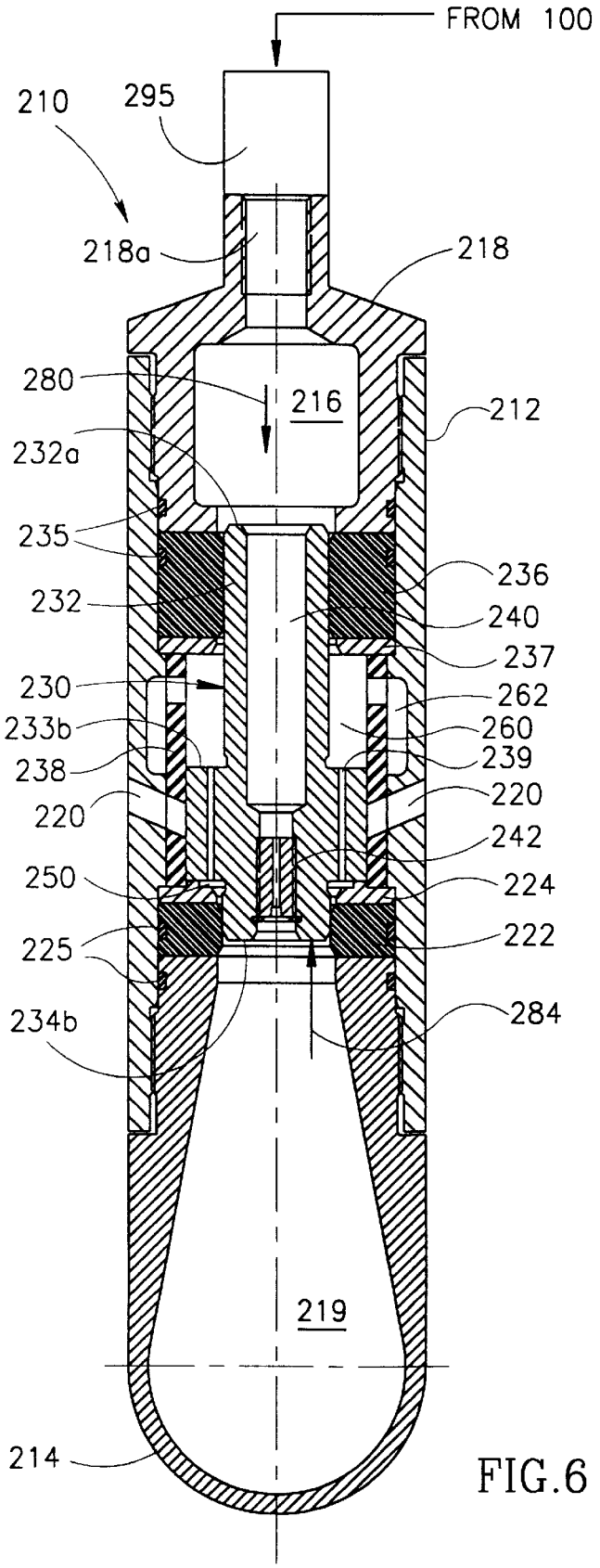
FIG. 6 is an axial sectional view of a gas impulse device constructed in accordance with a further alternative embodiment of the present invention, wherein a controlling valve unit is connected to the device's inlet chamber.

Turning now to FIG. 6, there is seen a gas impulse device, referenced 210, which is constructed and arranged in accordance with a further alternative embodiment of the invention. In this figure, components similar to those of device 10, are depicted with similar reference numerals to those of FIGS. 2–4, but with the addition of a prefix "2".

In contrast to devices 10 and 110—which as noted above are self-firing devices—gas impulse device 210 is constructed and arranged such that the timing of its firing may be easily controlled; either by an operator for example, or by a suitable controlling system such as a computerized control system. Thus, whilst being configured generally similar to device 10, gas impulse device 210 incorporates a controlling valve unit 295 which is arranged between inlet port 218*a* and conduit 102 (FIG. 1), and serves to control the supply of gas to inlet chamber 216. Furthermore, piston unit 230 has a piston body end surface 232*a* which is larger than piston nose end surface 234*b*, so that firing of the piston unit will not automatically occur upon compressed gas entering pressurization chamber 219.

In operating device 210, valve unit 295 is set in a first operative position, preferably by means of a solenoid mechanism, so that compressed gas is fed from high pressure external gas source 100 (FIG. 1) to inlet chamber 216 via conduit 102 (FIG. 1), thereby causing a downstream flow of gas as indicated by arrow 280 (FIG. 2). The continued supply of gas to inlet chamber 216 is operative to move piston unit 230 downstream into its "pre-firing" first extreme position as illustrated in FIG. 6, as well as to cause a flow of compressed gas into pressurization chamber 219 via passage 240 and orifice element 242. These processes are substantially the same as those described above in relation to device 10, and thus are not repeated herein.

Upon command of an externally generated electrical signal, valve unit 295 is moved into a second operative position, whereby gas communication between conduit 102 and inlet chamber 216 is closed off, and gas is released from the inlet chamber into the environment via one or more holes in the valve unit (not shown). As a result of the sharp decrease in pressure within inlet chamber 216, the force applied to piston nose end surface 234*b*, as denoted by arrow 284, will be sufficient to cause an initial upstream movement of piston unit 230.

As previously described in relation to device 10, the withdrawal of piston nose 234 from damper ring 222 and ring element 224, exposes shoulder 233*a* of piston head 233 to the gas pressure within pressurization chamber 219, thereby causing a sudden, rapid movement of piston unit 230 towards inlet chamber 216. This rapid upstream movement of piston unit 230 towards its second extreme position (i.e. corresponding to the position of piston unit 30 in FIG. 4), allows for gas communication between pressurization chamber 219 and discharge ports 220, so as to generate a gas blast in a manner substantially similar to that described above in relation to device 10. Furthermore, discharge ports 220 are preferably inclined like discharge ports 20 of device 10, so that a blast produced by device 210 will be operative to cause jet propulsion of the gas impulse apparatus.

As noted above, it is a particular feature of the current embodiment, that the firing of device 210 may be controlled by an operator or suitable computerized controlling program. Thus, where additional firing of the apparatus is desired, further electrical signals are sent to valve unit 295 at appropriate time intervals, so as to repeat the process described above.

It is also noted that a further feature of gas impulse device 210 is that the provision of valve unit 295, allows for a series or "string" of such devices to be connected together. In such case, a first device 210 is directly connected to gas source 100 (FIG. 1) via conduit 102, and additional devices 210 are connected in series, preferably via their inlet chambers 216 so as to enable the transfer of gas along the series of devices 210 when valve units 295 are set in their first operative positions.

Returning now to a further consideration of the preferred embodiment of the invention, FIGS. 1 and 7–9 illustrate and exemplify use of gas impulse device 10 in a plurality of environments Generally speaking, the apparatus of the invention may be employed in the rehabilitation and maintenance of water or oil wells, including vertical, horizontal and inclined wells, as well as for the cleaning and maintenance of pipelines of any type. Similarly, the apparatus of the invention may be used for the cleaning and maintenance of tanks, bins, crucibles, channels, reservoirs, and other similar liquid or dry storage and transport facilities as previously indicated. Furthermore, the gas impulse apparatus of the invention may be used in combination with chemical treatment techniques, generally similar to those discussed in further detail in conjunction with FIGS. 13–15.

Figure 8:
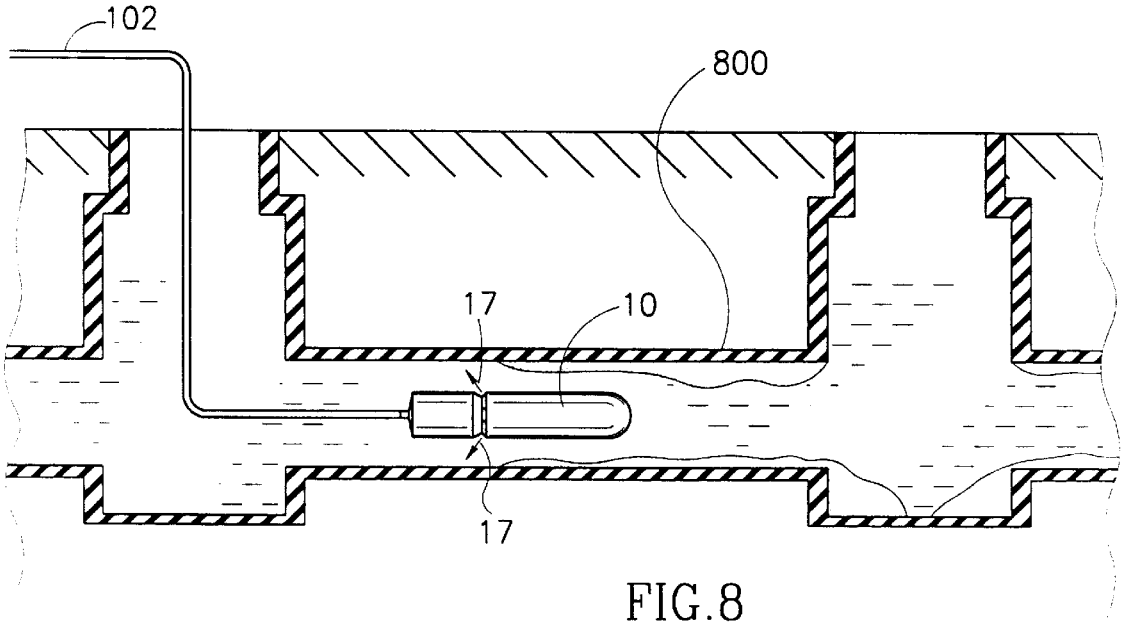
FIG. 8 is a schematic illustration of the gas impulse device of FIGS. 1–4 inserted for use in a sewer pipeline.
Figure 9:
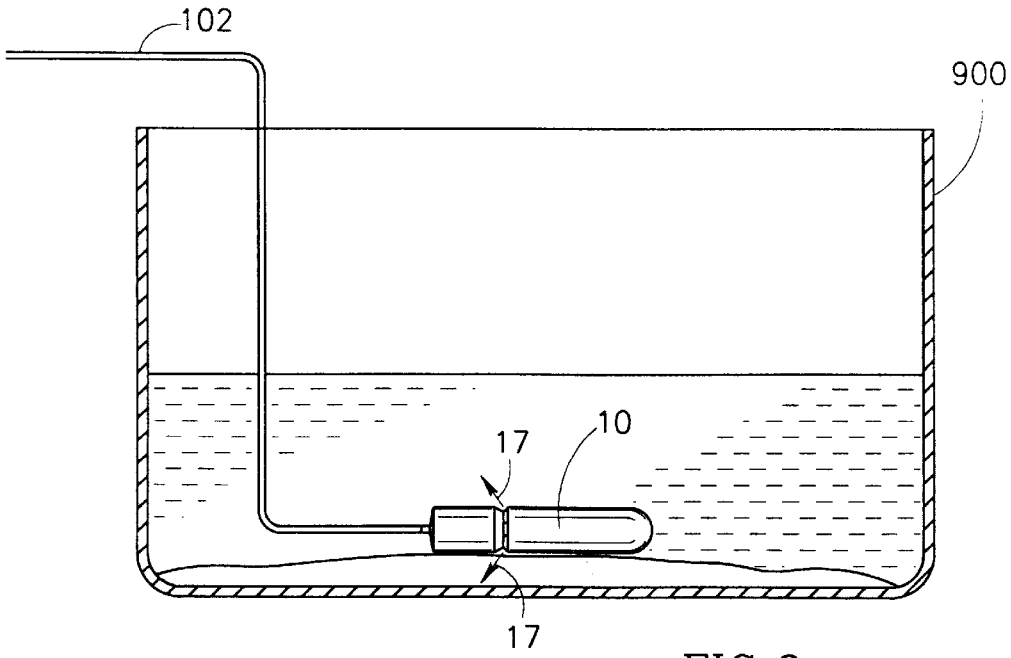
FIG. 9 is a schematic illustration of the gas impulse device of FIGS. 1–4 inserted for use in a reservoir.

By way of non-limiting example, FIGS. 1 and 7–9 illustrate device 10 inserted for use in the following environments: a water or oil well, referenced 500 (FIG. 1), an inclined pipeline, referenced 700 (FIG. 7) such as may be used in industrial production facilities, a horizontal sewer pipeline, referenced 800 (FIG. 8), and a reservoir, referenced 900 (FIG. 9). These drawings also illustrate operation of gas impulse device 10 in a plurality of orientations ranging from vertical positioning (FIG. 1), inclined positioning (FIG. 7), and horizontal positioning (FIGS. 8 and 9).

Figure 10:
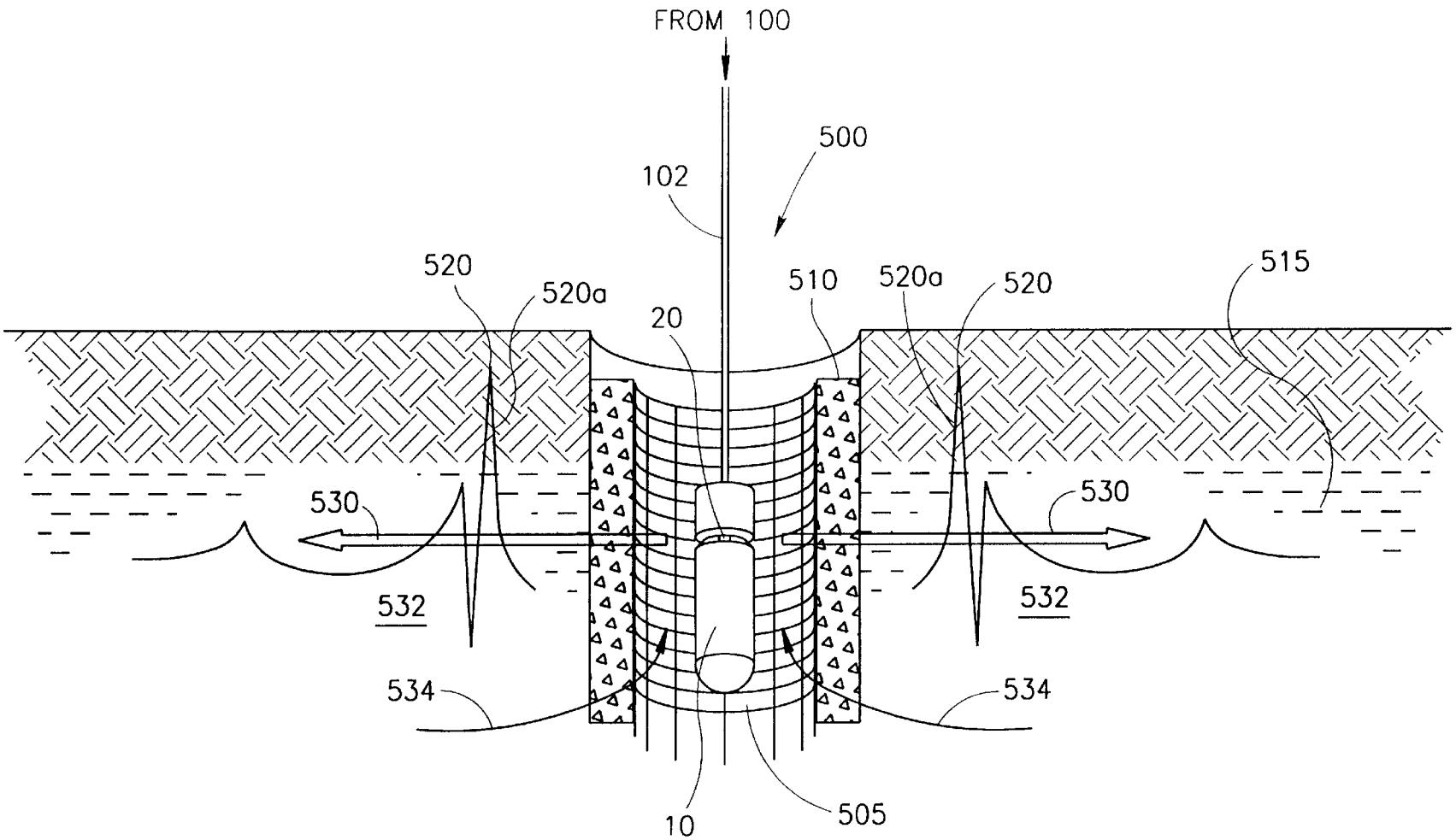
FIGS. 10–12 are schematic illustrations of various pressure phases resulting from a gas blast generated by the gas impulse device of FIGS. 1–4.
Figure 11:
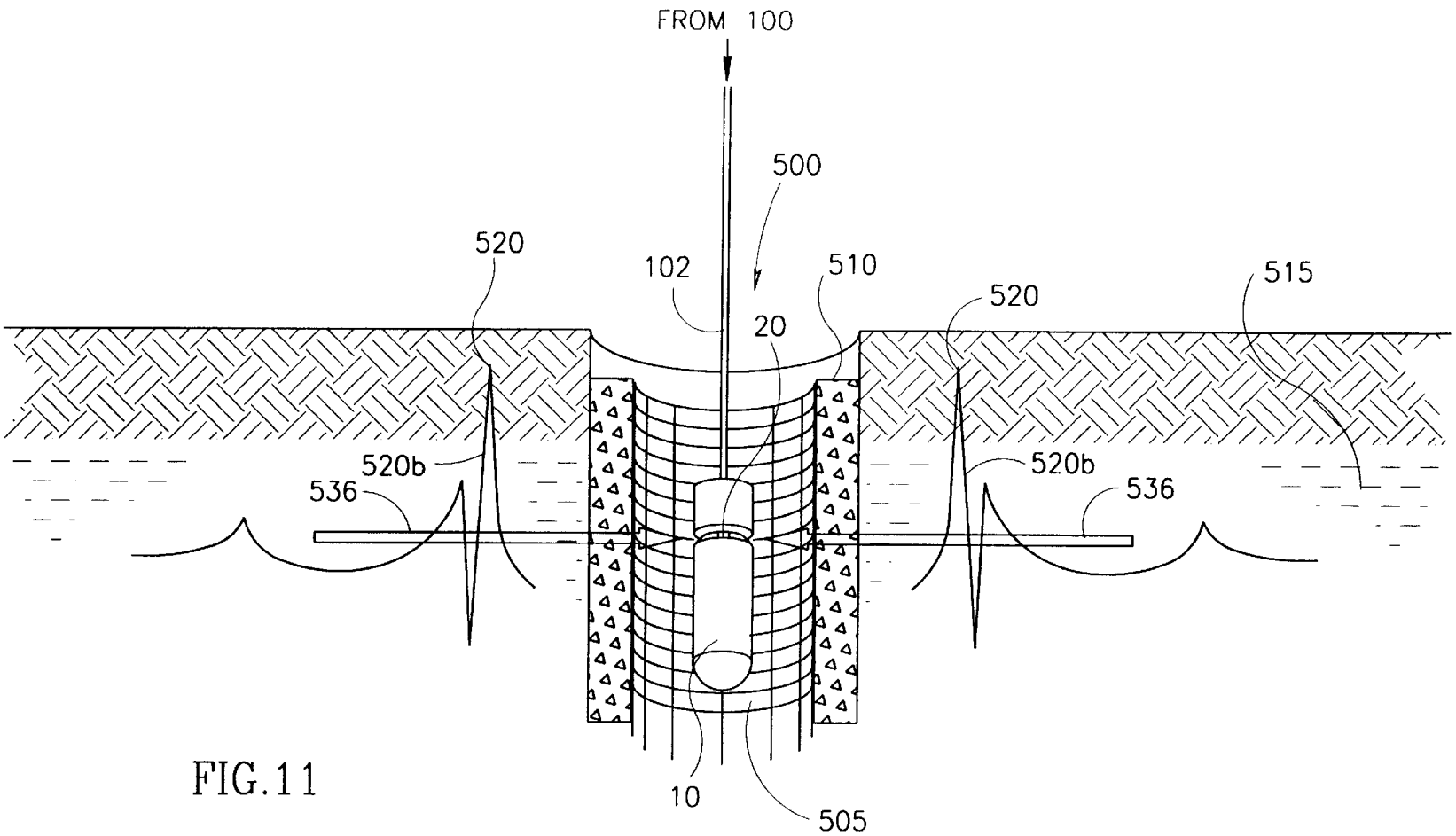
Figure 12:
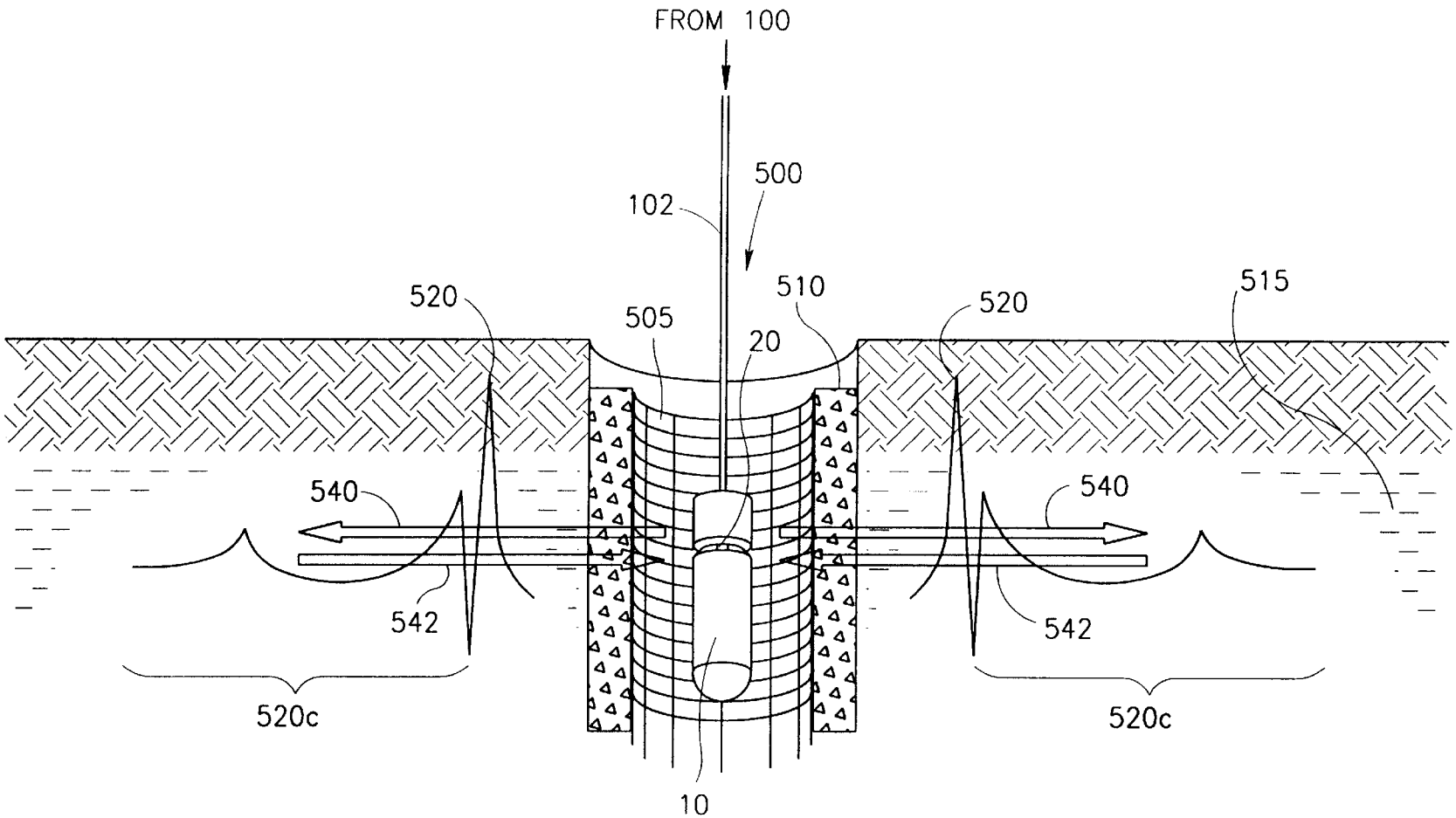

Referring now to FIGS. 10–12, operation of gas impulse device 10 is described, in the context of performing well rehabilitation and maintenance.

As illustrated in FIGS. 10–12, device 10—which is connected to an external gas supply 100 (FIG. 1) via supply conduit 102—is lowered into a well, referenced 500. In the example at hand, well 500 is a water well encompassed by a porous well screen 505. A water-permeable gravel pack 510 separates well screen 505 from a surrounding aquifer, referenced 515, within which the well 500 is located. Upon the release of pressurized gas from gas impulse device 10 in the manner described hereinabove, a high pressure gas bubble (not seen) is created. This high pressure gas bubble gives rise to a powerful shock wave, which is illustrated as a pressure wave, referenced 520, in FIGS. 10–12. In the description set forth hereinbelow, the effect of pressure wave 520 is described in association with three pressure phases which result from the gas blast generated by impulse device 10.

Referring more specifically to FIG. 10, the first resulting pressure phase of a gas blast generated by device 10 is depicted by a portion 520*a* of wave 520 having a sharp positive gradient as seen. Wave portion 520*a* denotes a sharp increase in pressure in the region of well 500 and aquifer 515 surrounding the device's discharge ports 20. This increase in pressure has the desirable effect of dislodging deposits from adjacent portions of well screen 505, as well as fracturing the deposits due to a sudden increase in pressure within the deposit pores. It is noted that the magnitude of impulse pressure required to dislodge deposits from the well screen, will be less than the magnitude of static pressure necessary to achieve an equivalent result.

As is also indicated in FIG. 10, the above-described high pressure gas bubble and associated shock wave generates a strong outward flow of water through screen 505 and gravel pack 510 into aquifer 515, as depicted by arrows 530. In cases where these outward flows are generated by impulses emanating from inclined discharge ports 20—such as are included in impulse device 10 (FIGS. 2,3 and 4)—a region of low pressure, referenced 532, forms beneath each strong outflow of water, which in turn gives rise to an inflow of water from aquifer 515 into well 500 as illustrated by arrows 534. These outflows of water into aquifer 515, and inflows of water into well 500, are operative to further dislodge and wash away deposits and encrustations from screen 505 and gravel pack 510 as they travel therethrough.

Referring now to FIG. 11, the second phase resulting from a blast of gas impulse device 10 is indicated by a portion 520*b* of wave 520 having a sharp negative gradient as seen. During this phase, the high pressure gas bubble created by the firing of device 10, enlarges and loses pressure as it travels through the water medium of well 500. Upon coming into contact with screen 505, the enlarged gas bubble is divided into a plurality of pulsating smaller gas bubbles (not shown). Thus the pressure in the treated zone decreases such that water from well 500 and aquifer 515—previously pushed outwards by the former high pressured gas bubble begins to flow back into the well, thereby generating a strong backflow of water into well 500. Arrows 536 of FIG. 11 depict a pair of water streams flowing back into well 500 at these locations.

Referring now to FIG. 12, portions 520*c* of wave 520 depict the third pressure phase of a gas blast produced by gas impulse device 10. In effect, this phase is a combination of an alternating series of the first two pressure phases described above, on a diminishing scale, wherein derivative pressure waves resulting from the original shock waves, generate further rises and falls in pressure which diminish in magnitude over time. These derivative pressure waves also lead to outward and inward flows of water between well 500 and aquifer 515, as depicted by arrows 540 and 542 of FIG. 12, which similarly decrease in strength over time.

Considering now the combined pulsating effect of the three pressure phases described above in conjunction with FIGS. 10–12, it is seen that the apparatus and method of the invention provide an effective means for performing well rehabilitation and maintenance. Among the factors contributing to the effective dislodging, and in some cases destruction, of deposits and encrustations in the processes described above, are the effects produced by:

(a) the repeated powerful shock waves generated by gas impulses;

(b) the resulting vibrations of surfaces upon which the deposits or encrustations are lodged;

(c) the strong liquid flows through surfaces upon which the deposits or encrustations are lodged (e.g. liquid flows from well 500 to surrounding aquifer 515 and back, which pass through screen 505 and gravel pack 510); and (d) the sudden increase in pressure within the pores of deposits or encrustations, thereby resulting in the fracture of those deposits or encrustations.

Furthermore, in apparatus where inclined discharge ports are employed to produce jet forces, any buoyant forces emanating from the aforesaid shock waves and liquid flows, will be counter-balanced by the jet force generated with each gas blast. In this way, undesired jerking of the gas impulse apparatus being used may be eliminated, thereby enabling the continuous and accurate treatment of various zones of well 500 as the apparatus moves in a downward direction.

Figure 13:
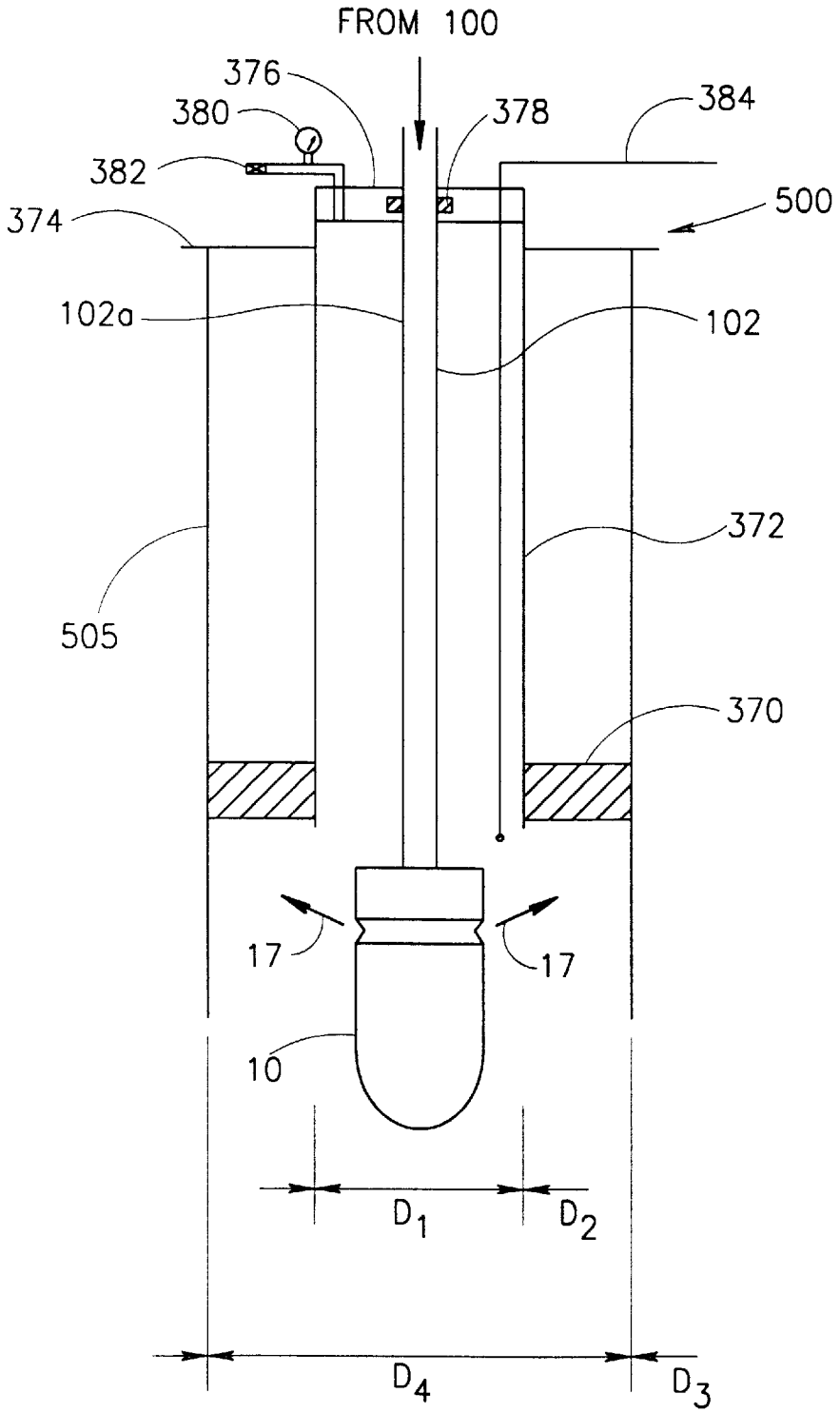
FIG. 13 is a schematic illustration of the gas impulse device of FIGS. 1–4 inserted for use in a well and operated in conjunction with a packer unit.

Referring now to FIG. 13, operation of gas impulse device 10 for performing well rehabilitation is described in accordance with an alternative method of the invention. As seen in FIG. 13, impulse device 10 is operated in conjunction with a cylindrical packer unit, referenced 370, which is inserted into well 500 above the gas impulse device. When operating device 10 as described in conjunction with FIGS. 2–4, packer unit 370 functions to enhance the propagation of wave energy throughout the area of the well being treated, by reducing the upward displacement of water. The inclusion of a packer unit also aids in a more effective dispersion of chemical reagent where chemical treatment is combined with gas blasting.

Considering now FIG. 13 in more detail, packer unit 370 is seen to be fitted between a supporting pipe 372 and well screen 505. Pipe 372 is in turn supported and centralized by means of a stabilizing element, referenced 374, and is covered by a cap, referenced 378. In order for packer unit 370 to fit tightly between pipe 372 and well screen 505, the packer unit preferably has an inner diameter, $D_1$, roughly equal to the outer diameter, $D_2$, of supporting pipe 372, and an outer diameter, $D_3$, roughly equal to the inner diameter, $D_4$, of well screen 505.

In accordance with the alternative method of the invention, compressed gas is fed from external gas source 100 (FIG. 1) to inlet chamber 16 of device 10, via conduit 102 in generally the same manner as described above in conjunction with FIGS. 2–4. As seen in FIG. 13, conduit 102 extends through cap 376, and for reasons which will be understood from the following description, preferably has a smooth outer surface 102*a*. A suitable sealing element 378 is also provided to seal the area of contact between conduit 102 and cap 376.

As device 10 is fired by the continued supply of gas to inlet chamber 16, the jet force created by each firing of the device, will be operative to overcome the frictional force which exists between sealing element 378 and outer surface 102*a* of supply conduit 102, thereby causing a downward displacement of device 10 so as to enable the continuous treatment of various zones within the well 500. Typically, a manometer referenced 380 is used to measure pressure at the top of well 500, and a discharger 382 is provided for dissipating excess pressure as required.

In another method of the invention—wherein device 10 and packer unit 370 are used in combination with chemical agents employed to enhance the well rehabilitation process—a further measurement device, referenced 384, may optionally be provided. By way of example, device 384 may take the form of a pH measuring device, where acid is used in conjunction with gas impulse device 10 and packer unit 370.

The use of chemical agents in well rehabilitation and similar processes is well known in the art, and hence not described herein in great detail. For purposes of completeness however, the present method may be exemplified by the addition of chlorine directly into the well, prior to commencing operation of gas impulse device 10, so as to form a weak acid. Similarly, the supply of compressed carbon dioxide ($CO_2$) from gas source 100 (FIG. 1) to inlet chamber 16, will be operative to produce carbonic acid ($H_2CO_3$) upon release of the compressed gas into the well under high pressure during operation of device 10.

Figure 14:
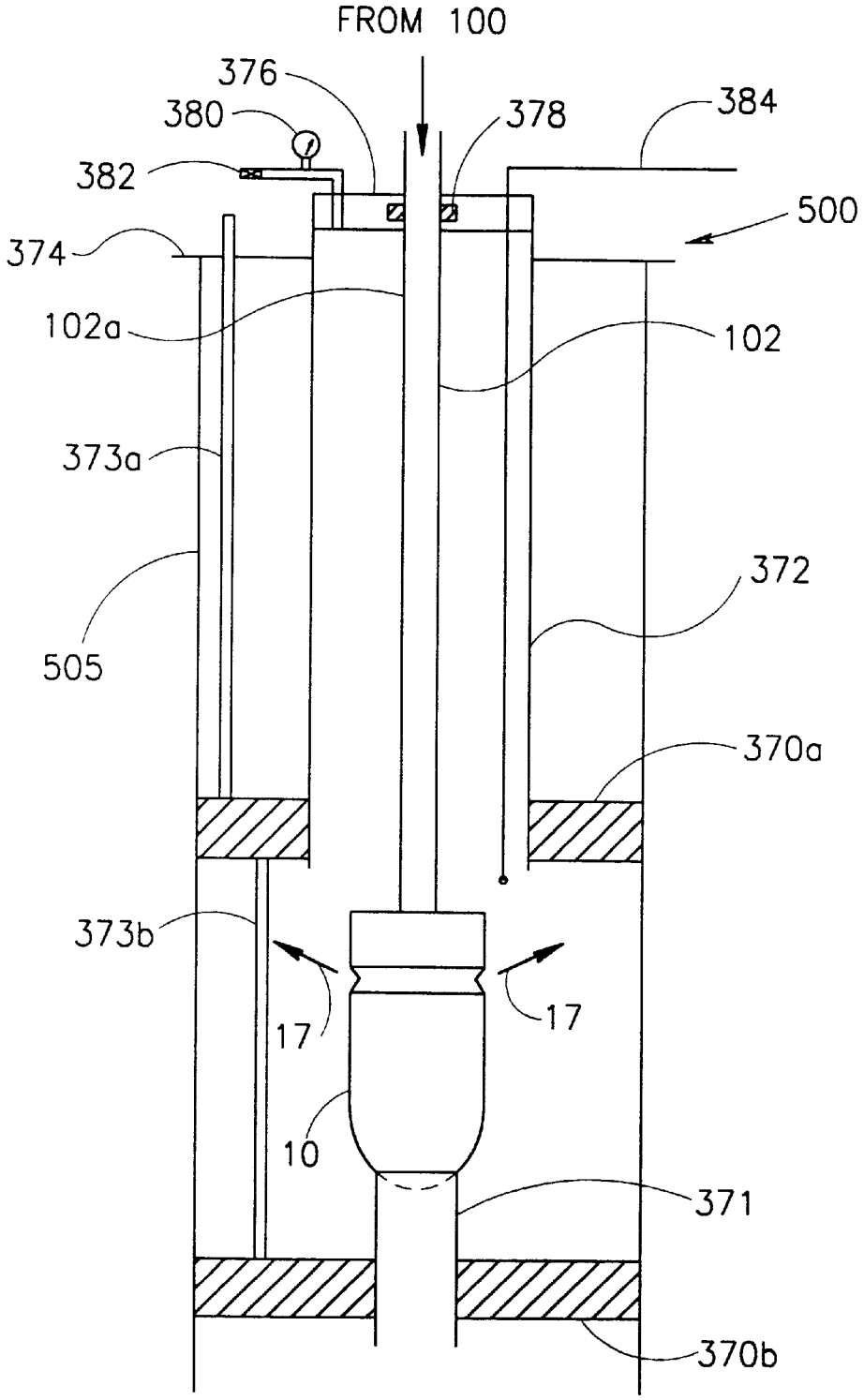
FIG. 14 is a schematic illustration similar to FIG. 13, depicting the gas impulse device of FIGS. 1–4 inserted for use in a well and operated in conjunction with two packer units arranged in a straddle arrangement.

In yet a further alternative method of the invention, more than one packer 370 may be used in conjunction with the gas impulse apparatus of the invention. Thus, for example, a device 10 may be used in conjunction with two packer units, arranged in a straddle arrangement such as is seen in FIG. 14, whereby device 10 is lowered into a well or other facility between two packers 370*a* and 370*b*, so as to isolate the impulse pressures produced upon operation of device 10 to a region of the well defined by the region located between the two packer units. In accordance with known methods, packer units 370*a* and 370*b* may be inflatable packers—wherein packer unit 370*a* is supported between pipe 372 and screen 505 as previously seen in conjunction with FIG. 13, and packer 370*b* is supported between well screen 505 and an extension pipe 371 which may be threaded onto an end of device 10 for example. FIG. 14 also depicts inflating pipes 373*a* and 373*b* by means of which packer units 370*a* and 370*b* are inflated.

Figure 15:
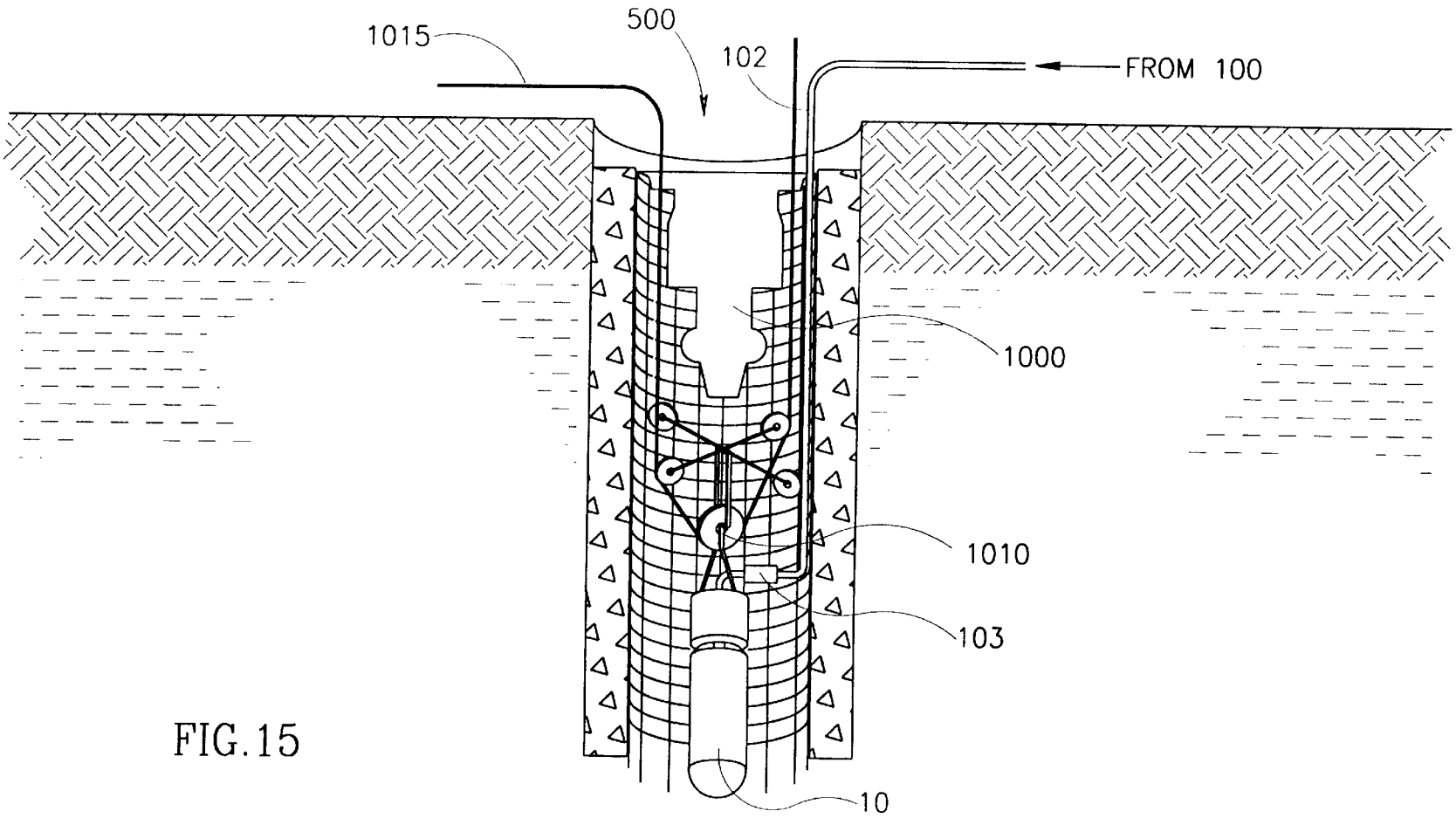
FIG. 15 is a schematic illustration of the gas impulse device of FIGS. 1–4 permanently or semi-permanently installed for use in a well, and operable in conjunction with a guiding and centralizing mechanical pulley system.

Turning now to FIG. 15, operation of a gas impulse device for performing well rehabilitation and maintenance is described in accordance with yet a further embodiment of the invention wherein the impulse apparatus is permanently or semi-permanently installed within a well. Such installation may be useful where it is expedient to deploy gas impulse apparatus within a well on a long term basis, thereby obviating the need for costly and time-consuming hoisting, pump connection and pump disconnection procedures.

In accordance with the present embodiment, a self-firing gas impulse device—or alternatively, a valve-operated gas impulse device—is installed inside a water or oil well, and is typically supported by a pulley system which is operative to guide and centralize the gas impulse apparatus. By way of example, FIG. 15 illustrates a self-firing gas impulse device 10, installed within a water well 500 below a turbine 1000, and suspended from a mechanical pulley system, referenced 1010. Connected to pulley system 1010, is a preferably steel operating string, referenced 1015, which enables lowering and raising of device 10 as required.

In use, compressed gas is supplied from source 100 (FIG. 1) to inlet chamber 16 of device 10, via conduit 102, as previously described. After each firing of impulse device 10, the gas apparatus is lowered either by means of a jet force achieved through the provision of inclined discharge ports 20 (FIGS. 2–4), or alternatively, with the aid of string 1015 such as may be controlled by an operator. After a desired section of well 500 has been treated, the gas impulse apparatus may be raised by means of steel string 1015 and pulley system 1010, and stored in an appropriate section of the well. A directional valve, referenced 103, is typically provided within conduit 102 to prevent a backflow of gas towards source 100, in order that a pressure equilibrium is able to be maintained between the pressure inside device 10 and the hydrostatic pressure within well 500. This equilibrium of pressure, together with the final positioning of piston unit 30 in its first extreme position (FIG. 2) upon conclusion of the firing process, ensures that water will not enter device 10 through discharge ports 20 during storage of the device.

It is noted that in accordance with the present embodiment of the invention, well treatment by means of a permanently or semi-permanently installed gas impulse device, may also be used in conjunction with chemical treatment techniques as described above, so as to provide a highly effective treatment process.

Considering now the wider application of the gas impulse apparatus of the invention, it is noted that the gas impulse devices described hereinabove may also be used, or modified for use, in a formation-fracturing process, which in accordance with a method of the invention, provides significant advantages over known hydrofracturing techniques.

In brief, existing hydrofracturing techniques involve the injection of high pressure water into rock formations surrounding a water well, so as to increase the size of existing cracks and crevices formed therein, and in some cases to create new fractures. These techniques are commonly utilized in an effort to improve formation permeability and well yield. Generally one or two inflatable packers are used, and in some cases, propping agents or "proppants"—such as sand, plastic beads or glass—are used to keep open the fractures. It is an important aspect of the hydrofracturing process that only clean, disinfected water is injected into the formation crevices, since the use of contaminated water can result in contamination of the well being treated. Thus, it is not uncommon for a water well to become contaminated where the high pressure water used in a hydrofracturing procedure is taken from the surface water of the well.

As an alternative to the hydrofracturing technique described above, the gas impulse apparatus of the present invention may be utilized to achieve results similar to, and generally better than, common hydrofracturing techniques. In accordance with a method of the present invention, a gas impulse device such as device 10, is inserted into a well together with one or two packer units 370, and is operated in generally the same manner as previously described above in conjunction with FIGS. 13 and 14. The gas impulses thereby produced are operative to increase the size of existing fractures within a formation surrounding the well, as well as to create new fractures therein. As with regular hydrofracturing techniques, proppants for supporting open fractures may be introduced into the well prior to operation of the apparatus.

One difference however, between the present method and the methods described in conjunction with FIGS. 13 and 14, is that in the present case, pressure is not dissipated via discharger 382 during the continued operation of device 10. Thus, the present method provides for a continuing increase in pressure within a well, thereby assisting in the fracturing process achieved by gas impulse device 10.

Comparing the operation of gas impulse device 10 to that of known hydrofracturing apparatus, the present invention provides a number of advantages over common hydrofracturing techniques. These advantages include: a minimal risk of well contamination through the use of a gas injection process rather than a water injection process; a higher effectiveness of sudden gas impulses produced in accordance with the invention, as compared to the slower increasing liquid pressures employed in hydrofracturing techniques; and, an elimination of the need for separate well-cleaning apparatus and hydrofracturing equipment.

It will be appreciated by persons skilled in the art, that the full scope of the invention and its applications, extends well beyond the various embodiments of the invention described hereinabove. As exemplified above, the gas impulse apparatus of the invention may be easily used, or modified for use, in conjunction with a number of well-cleaning, rehabilitation and maintenance techniques already existing and known in the art. Similarly the described apparatus may be used to clean and maintain other liquid or dry storage and transport facilities in conjunction with related known methods. For the purposes of completeness, it is noted that such methods are contemplated as falling within the scope of the invention, even though they may not be explicitly referred to herein.

It will thus be appreciated by persons skilled in the art, that the present invention is not limited by what has been shown and described hereinabove merely by way of illustrative example. Rather, the scope of the present invention is limited solely by the claims which follow:

What is claimed is:

1. A gas impulse device which includes:

a housing having a longitudinal axis, a gas inlet port, and at least one gas discharge port;

an inlet chamber, arranged for gas communication with a source of compressed gas via said inlet port and operative to receive compressed gas therefrom;

a pressurization chamber arranged for gas communication with said inlet chamber thereby to facilitate a build-up of pressurized gas therein, and arranged for selectable gas communication with said at least one discharge port;

a piston unit arranged along said longitudinal axis of said housing between said inlet chamber and said pressurization chamber, and selectably movable between a first operative position and a second operative position, whereat in said first operative position said piston unit prevents gas communication between said pressurization chamber and said at least one discharge port, and whereat in said second operative position said piston unit is retracted so as to facilitate gas communication between said pressurization chamber and said at least one discharge port; and a sealing arrangement arranged between said pressurization chamber and said at least one discharge port, wherein, when said piston unit is in said first operative position, at least a portion of said piston unit is operative to enter into mating engagement with at least a portion of said sealing arrangement, and wherein, when said piston unit is in mating engagement with said sealing arrangement, said piston unit and said sealing arrangement cooperate so as to prevent gas communication between said pressurization chamber and said at least one discharge port, and wherein said piston unit is operative to move between said first and said second operative positions in response to a force differential across said piston unit in a direction parallel to said longitudinal axis, such that when said piston unit is in said first operative position and the gas pressure in said pressurization chamber is of at least a predetermined magnitude, said piston unit is operative to move towards said second operative position in response to an at least predetermined minimum force differential thereby to facilitate a paid high pressure exhaustion of gas in said pressurization chamber to the exterior of said housing via said at least one discharge port.

2. A gas impulse device according to claim 1, wherein said inlet port is formed at an upstream end of said gas impulse device, and wherein said pressurization chamber is formed at a downstream end of said gas impulse device.

3. A gas impulse device according to claim 2, wherein said piston unit includes an upstream-facing end portion having an upstream-facing end surface and a downstream-facing end portion having a downstream-facing end surface.

4. A gas impulse device according to claim 3, wherein when said piston unit is in said first operative position, said inlet chamber is operative to contain a gas having a pressure of up to a first magnitude and said pressurization chamber is operative to contain a gas having a pressure of up to a second magnitude, and wherein when said upstream-facing end surface is exposed to the gas pressure of the first magnitude a first force is developed thereat, and when said downstream-facing end surface is exposed to the gas pressure of the second magnitude a second force is developed thereat, and wherein the at least predetermined minimum force differential corresponds to the difference in the respective magnitudes between the first and second forces.

5. A gas impulse device according to claim 4, wherein the at least predetermined minimum force differential is related to the ratio between the first and second gas pressure magnitudes and the ratio between the areas of said end surfaces.

6. A gas impulse device according to claim 4, wherein the area of said downstream-facing end surface is greater than the area of said upstream-facing end surface and wherein the second magnitude of gas pressure is less than the first magnitude of gas pressure.

7. A gas impulse device according to claim 3, wherein the area of said downstream-facing end surface is smaller than the area of said upstream-facing end surface.

8. A gas impulse device according to claim 2, wherein said first operative position includes a first extreme position and wherein said second operative position includes a second extreme position and wherein the movement of said piston unit towards said second operative position in response to the gas pressure and the at least predetermined minimum force differential, includes a movement of said piston unit towards said second extreme position.

9. A gas impulse device according to claim 8, wherein said piston unit includes an upstream-facing end portion having an upstream-facing end surface and a downstream-facing end portion having a downstream-facing end surface, and wherein the movement of said piston unit towards said second operative position in response to the at least predetermined minimum force differential is a first movement of said piston unit out of mating engagement with said sealing arrangement and wherein said piston unit has a further downstream-facing surface such that upon said piston unit moving out of mating engagement with said sealing arrangement, said further downstream-facing surface suddenly becomes exposed to the pressurized gas within said pressurization chamber, thereby to cause said piston unit to rapidly move towards said second extreme position in a second movement and so as to cause the rapid high pressure exhaustion of gas.

10. A gas impulse device according to claim 8, and also including a variable-sized discharge chamber arranged between said pressurization chamber and said at least one discharge port such that when said piston unit is in mating engagement with said sealing arrangement, said piston unit and said sealing arrangement also cooperate so as to prevent gas communication between said pressurization chamber and said discharge chamber, and wherein when said piston is not in mating engagement with said sealing arrangement as communication between said pressurization chamber and said discharge chamber is facilitated, and wherein said discharge chamber increases in size as said piston unit moves from said first extreme position towards said second extreme position, and wherein the rapid high pressure exhaustion of gas from said pressurization chamber to the exterior of said housing is also via said discharge chamber.

11. A gas impulse device according to claim 10, wherein said portion of said piston unit is a first portion of said piston unit and said sealing arrangement is a first sealing arrangement, and wherein said gas impulse device also includes a second sealing arrangement arranged between said inlet chamber and said pressurization chamber and upstream of said first sealing arrangement.

12. A gas impulse device according to claim 11, and also including a variable-sized damper chamber arranged between a second portion of said piston unit and said second sealing arrangement such that when said piston unit moves from said first extreme position towards said second extreme position, said damper chamber decreases in size thereby to increase the pressure therein so as to apply a damping force to said piston unit.

13. A gas impulse device according to claim 12, wherein said damper chamber is arranged upstream with respect to said discharge chamber.

14. A gas impulse device according to claim 12, and also including at least one cavity formed within said housing, wherein said at least one cavity is arranged for selectable gas communication with said damper chamber, and wherein following the movement of said piston unit out of said first operative position towards said second extreme position said piston unit is further operative to prevent the selectable gas communication between said damper chamber and said at least one cavity thereby to further increase the damping force applied to said piston unit.

15. A gas impulse device according to claim 12, wherein said piston unit includes at least one bore, and wherein said at least one bore is operative to facilitate gas communication between said discharge chamber and said damper chamber so as to maintain generally equal pressures therebetween when said piston unit is in said first operative position.

16. A gas impulse device according to claim 1, wherein said pressurization chamber communicates with said inlet chamber via a generally cylindrical passage which extends through said piston unit.

17. A gas impulse device according to claim 1, wherein said inlet chamber communicates with said inlet port via an air admission conduit which extends through said piston unit.

18. A gas impulse device according to claim 13, wherein said pressurization chamber communicates with said inlet chamber via an annular gap arranged between a generally cylindrical inner surface of said piston unit and a generally cylindrical outer surface of said air admission conduit.

19. A gas impulse device according to claim 1, and also including apparatus for controlling the supply of gas to said inlet chamber.

20. A gas impulse device according to claim 19, wherein said apparatus for controlling the supply of gas to said inlet chamber includes apparatus for selectably releasing gas from said inlet chamber.

21. A gas impulse device according to claim 19, wherein said inlet chamber is configured for gas communication with the inlet chamber of another gas impulse device thereby to enable the controlled supply of gas to a plurality of interconnected gas impulse devices.

22. A gas impulse device according to claim 19, wherein said apparatus for controlling the supply of gas to said inlet chamber includes a valve unit.

23. A gas impulse device according to claim 22, wherein said valve unit is an automatic valve unit.

24. A gas impulse device according to claim 1, wherein said gas impulse device is a self-firing impulse device.

25. A gas impulse device according to claim 1, wherein said gas impulse device is configured for repeated firing in response to a continued supply of gas to said inlet chamber.

26. A gas impulse device according to claim 1, wherein said housing is a cylindrical housing.

27. A gas impulse device according to claim 1, wherein said at least one discharge port broadens as it extends towards the exterior of said housing.

28. A gas impulse device according to claim 1, wherein said at least one discharge port is arranged transverse to said longitudinal axis of said housing.

29. A gas impulse device according to claim 1, wherein said at least one discharge port is arranged at an angle less than ninety degrees with respect to said longitudinal axis of said housing.

30. A gas impulse device according to claim 29, wherein the rapid high pressure exhaustion of gas in said pressurization chamber to the exterior of said housing via said at least one discharge port is operative to impart a jet force to said gas impulse device.

31. A gas impulse device according to claim 30, wherein said jet force is operative to propel said gas impulse device in a predetermined direction.

32. A method of rehabilitating a container having therein a liquid and having a wall construction the wall construction having thereon undesired substances sought to be removed, wherein said method includes:

positioning within the liquid a gas impulse device in an orientation generally parallel to a portion of the wall construction; and operating the gas impulse device so as to repeatedly discharge cleaning jets of a predetermined gas towards the portion of the wall construction, thereby to separate the undesired substances therefrom, and thereby also to propel the gas impulse device along a travel path generally parallel to the portion of the wall construction thus to deliver successive cleaning jets to successive portions of the wall construction.

33. A method according to claim 2, wherein said step of operating the gas impulse device includes the step of selectably supplying compressed gas to the gas impulse device, including selectably releasing compressed gas from the gas impulse device.

34. A method according to claim 32, wherein said step of operating the gas impulse device includes supplying to the gas impulse device a compressed gas whose main component is selected from the group consisting of:

(i) air, and (ii) nitrogen.

35. A method according to claim 32, wherein said step of operating the gas impulse device includes supplying to the gas impulse device a compressed gas whose main component is carbon dioxide, so as to give rise to the formation of carbonic acid upon operation of the device.

36. A method according to claim 32, and also including the step of introducing a chemical compound into the liquid prior to said step of operating the gas impulse device, so as to give rise to a chemical reaction of the chemical compound with the undesired substances.

37. A method according to claim 32, wherein the container is a well and said step of operating the gas impulse device causes liquid displacement and an increase in pressure in the well, and wherein said method also includes the step of packing at least a region of the well prior to said step of operating the gas impulse device, so as to limit the liquid displacement in the packed region and to substantially maintain the pressure increase therein.

38. A method according to claim 37, and also including the step of releasing excess pressure from the packed region of the well so as to prevent an increase of pressure within the well of greater than a predetermined magnitude.

39. A method according to claim 37, wherein the wall construction includes a rock formation containing a liquid flow, and wherein said method also includes the step of causing a continued increase in pressure within the packed region of the well, such that said step of operating the gas impulse device is operative to cause fracturing of a portion of the rock formation, thereby to improve a liquid flow therefrom into the well.

40. A method according to claim 39, and including the step of introducing a proppant into the well prior to said step of operating the gas impulse device, thereby to support fractures within the outer rock formation upon operation of the gas impulse device.

41. A method according to claim 37, and wherein said method also includes the step of introducing a chemical compound into the liquid prior to said step of operating the gas impulse device, so as to give rise to a chemical reaction of the chemical compound with the undesired substances.

42. A method according to claim 32, wherein said step of operating the gas impulse device includes the step of propelling the gas impulse device along a generally horizontal travel path.

43. A method according to claim 32, wherein said step of operating the gas impulse device includes the step of propelling the gas impulse device along a generally vertical travel path.

44. A method according to claim 32, wherein said step of operating the gas impulse device includes the step of propelling the gas impulse device along an inclined travel path.

45. A method of rehabilitating a container having therein a liquid and having a liquid permeable wall construction, the wall construction having thereon undesired substances sought to be removed, wherein said method includes:

positioning within the liquid a gas impulse device in an orientation generally parallel to a portion of the wall construction; and operating the gas impulse device so as to vent a discharge of gas at an angle generally less than ninety degrees relative to an axis of motion, so as to generate a blast of gas in the form of jets directed at an angle generally less than ninety degrees with respect to the axis of motion, and generally towards the wall construction, and so as to produce a series of liquid inflows and liquid outflows through the wall construction, thereby to separate the undesired substances therefrom.

46. A method according to claim 45, and including repeating said step of operating the gas impulse device so as to generate further blasts of gas in the form of jets directed at an angle generally less than ninety degrees with respect to the axis of motion, and generally towards the wall construction, and so as to produce further series of liquid inflows and liquid outflows through the wall construction.

47. A method according to claim 45, wherein said step of operating the gas impulse device includes the step of generating the blast of gas in the form of jets operative to propel the gas impulse device in a predetermined direction.

48. A method according to claim 47, and including repeating said step of operating the gas impulse device, thereby to also propel the gas impulse device along a travel path generally parallel to the portion of the wall construction.

49. A method according to claim 45, and also including the step of introducing a chemical compound into the liquid prior to said step of operating the gas impulse device so as to give rise to a chemical reaction of the chemical compound with the undesired substances.

50. A method according to claim 45, wherein the container is a well and said step of operating the gas impulse device causes liquid displacement and an increase in pressure in the well, and wherein said method also includes the step of packing at least a region of the well prior to said step of operating the gas impulse device, so as to limit the liquid displacement in the packed region and to substantially maintain the pressure increase therein.

51. A method according to claim 50, and also including the step of releasing excess pressure from the packed region of the well so as to prevent an increase of pressure within the well of greater than a predetermined magnitude.

52. A method according to claim 50, wherein the wall construction includes a rock formation containing a liquid flow, and wherein said method also includes the step of causing a continued increase in pressure within the packed region of the well, such that said step of operating the gas impulse device is operative to cause fracturing of a portion of the rock formation, thereby to a improve liquid flow therefrom into the well.

53. A method according to claim 52, and including the step of introducing a proppant into the well prior to said step of operating the gas impulse device, thereby to support fractures within the outer rock formation during said step of operating the gas impulse device.

54. A method according to claim 50, and wherein said method also includes the step of introducing a chemical compound into the liquid prior to said step of operating the gas impulse device, so as to give rise to a chemical reaction of the chemical compound with the undesired substances.

55. A method of rehabilitating a well, having therein a liquid and having a well screen the well screen having thereon undesired substances sought to be removed, wherein said method includes:

positioning within the liquid a gas impulse device in an orientation generally parallel to a portion of the well screen to be rehabilitated; and operating the gas impulse device so as to repeatedly discharge cleaning jets of a predetermined gas towards the portion of the well screen, thereby to separate the undesired substances therefrom, and thereby also to propel the gas impulse device along a travel path generally parallel to the portion of the well screen thus to deliver successive cleaning jets to successive portions of the well screen.

56. A method of rehabilitating a well having therein a liquid and having a well screen, the well screen having thereon undesired substances sought to be removed, wherein said method includes:

packing at least a region of the well, so as to limit liquid displacement therein and so as to substantially maintain a pressure increase therein;

positioning within the packed region of the well, a gas impulse device in an orientation generally parallel to a portion of the well screen; and operating the gas impulse device so as to discharge cleaning jets of a predetermined gas towards the portion of the well screen, and so as to cause an increase in pressure in the well, thereby to separate the undesired substances from the portion of the well screen.

57. A method according to claim 56, wherein said step of operating the gas impulse device includes discharging cleaning jets operative to propel the gas impulse device in a predetermined direction.

58. A method according to claim 57, and including repeating said step of operating the gas impulse device, thereby to also propel the gas impulse device along a travel path generally parallel to the well screen thus to deliver successive cleaning jets to successive portions thereof.

59. A method according to claim 56, and also including the step of releasing excess pressure from the packed region of the well, so as to prevent an increase of pressure of greater than a predetermined magnitude within the packed region of the well.

60. A method according to claim 56, wherein a rock formation containing a liquid flow surrounds the well, and wherein said method also includes the step of causing a continued increase in pressure within the packed region of the well, such that said step of operating the gas impulse device is operative to cause fracturing of a portion of the rock formation, thereby to improve a liquid flow therefrom into the well.

61. A method according to claim 60, and including the step of introducing a proppant into the well prior to said step of operating the gas impulse device, thereby to support fractures within the surrounding rock formation upon operation of the gas impulse device.

62. A method according to claim 56, and also including the step of introducing a chemical compound into the liquid prior to said step of operating the gas impulse device, so as to give rise to a chemical reaction of the chemical compound with the undesired substances.

* * * * *